US012557858B1

(12) United States Patent
Jacobs et al.

(10) Patent No.: US 12,557,858 B1
(45) Date of Patent: Feb. 24, 2026

(54) NURSING SLING WITH FOLDABLE PLATFORM

(71) Applicant: The Roo Baby, LLC, Evanston, IL (US)

(72) Inventors: Michelle Erin Jacobs, Costa Mesa, CA (US); Meghan Marie Bar, Evanston, IL (US)

(73) Assignee: The Roo Baby, LLC, Evanston, IL (US)

( * ) Notice: Subject to any disclaimer, the term of this patent is extended or adjusted under 35 U.S.C. 154(b) by 245 days.

(21) Appl. No.: 18/223,417

(22) Filed: Jul. 18, 2023

Related U.S. Application Data

(60) Provisional application No. 63/369,220, filed on Jul. 23, 2022.

(51) Int. Cl.
*A41D 1/215* (2018.01)
*A47D 13/02* (2006.01)

(52) U.S. Cl.
CPC ..... *A41D 1/215* (2018.01); *A47D 13/02* (2013.01)

(58) Field of Classification Search
CPC ..... A47D 13/02; A47D 13/025; A41D 1/215
USPC ..... 224/159, 160; D3/213
See application file for complete search history.

(56) References Cited

U.S. PATENT DOCUMENTS 1,464,404 A * 8/1923 Blekastad ..... A47D 13/025 224/159
5,224,637 A * 7/1993 Colombo ..... A47D 13/029 224/159
5,492,256 A * 2/1996 Ive ..... A47D 13/025 224/159
5,641,101 A * 6/1997 Nakayama ..... A47D 13/025 224/159
5,711,466 A * 1/1998 Kataoka ..... A47D 13/029 224/159
6,789,710 B1 * 9/2004 Szatkowski ..... A47D 13/025 224/159
D776,931 S * 1/2017 Lehan ..... D3/318
9,700,152 B2 * 7/2017 Telford ..... A47D 13/025
9,781,992 B2 * 10/2017 Lee ..... A47D 13/025
10,271,664 B2 * 4/2019 Yan ..... A47D 13/025
10,349,754 B2 * 7/2019 Kang ..... A47D 13/025
10,786,092 B1 * 9/2020 Yan ..... A47D 13/025
11,006,767 B1 * 5/2021 Lee ..... A47D 13/029
D1,041,874 S * 9/2024 Ge ..... D3/214
2018/0084923 A1 * 3/2018 Kang ..... A47D 13/025
(Continued)

FOREIGN PATENT DOCUMENTS

CN 109310218 B * 11/2021 ..... A47D 13/025
DE 102016115399 B4 * 6/2019 ..... A47D 13/025
EP 4316313 A1 * 2/2024 ..... A47D 13/025
(Continued)

*Primary Examiner* — Justin M Larson
(74) *Attorney, Agent, or Firm* — Lee & Hayes, P.C.

(57) ABSTRACT

A device includes a belt having a first attachment mechanism and a second attachment mechanism configured to engage to secure the belt to a user. The device further includes a first strap coupled to the belt, a second strap coupled to the belt, and a platform. The platform has a cover coupled to the belt, one or more panels disposed within the cover, and which are hingedly coupled to transition the platform between a folded configuration and unfolded configuration. Padding couples to the one or more panels.

7 Claims, 34 Drawing Sheets

(56) References Cited

U.S. PATENT DOCUMENTS

2024/0180340 A1* 6/2024 Nam ..... A47D 13/025

FOREIGN PATENT DOCUMENTS

| | | | | | |
|---|---|---|---|---|---|
| KR | 102029588 | B1 * | 10/2019 | ..... | A47D 13/025 |
| KR | 102297120 | B1 * | 9/2021 | ..... | A47D 13/029 |
| KR | 20220002465 | U * | 10/2022 | ..... | A47D 13/025 |
| KR | 102612662 | B1 * | 12/2023 | ..... | A47D 13/02 |

* cited by examiner

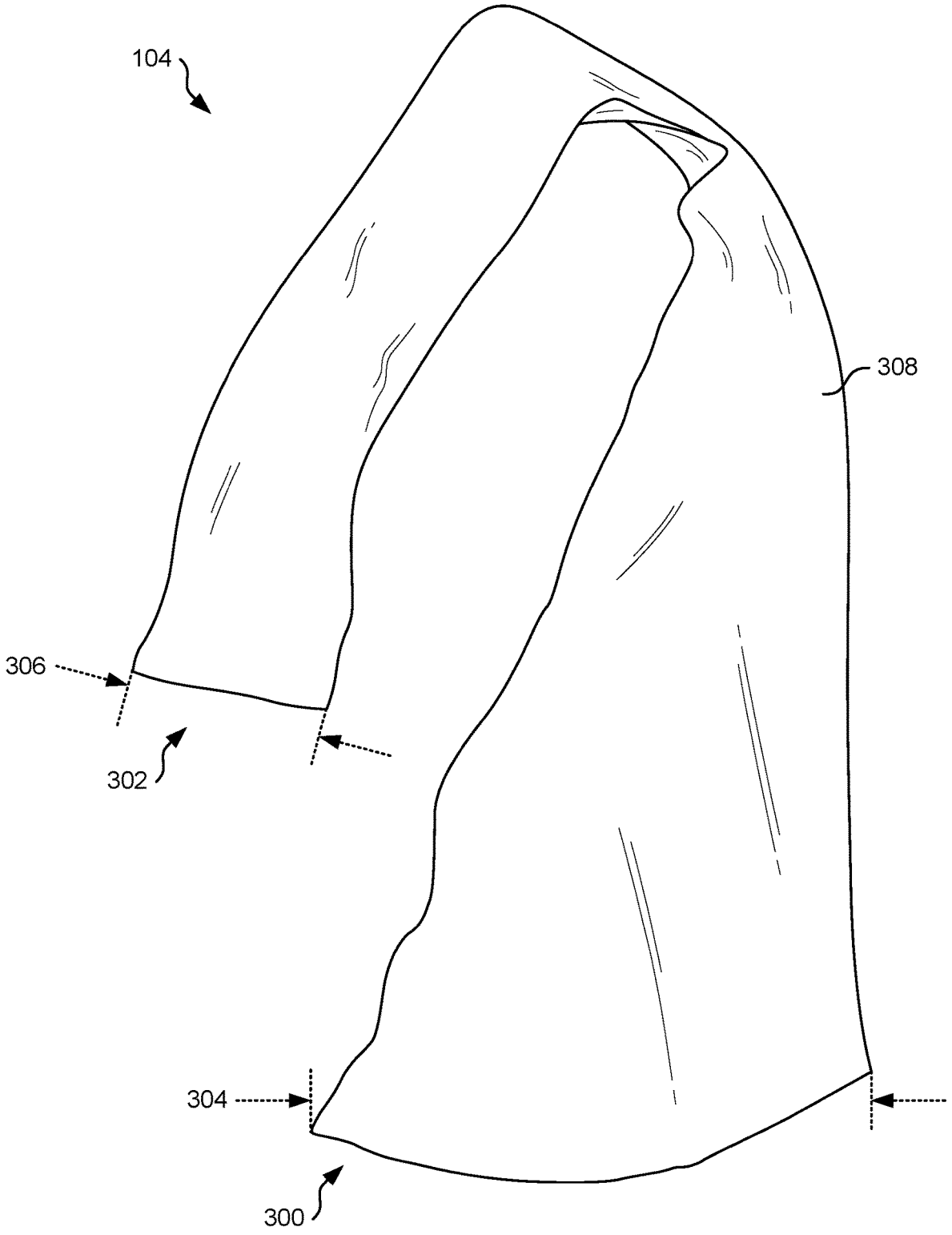
FIG. 3A
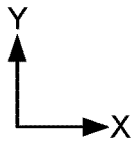

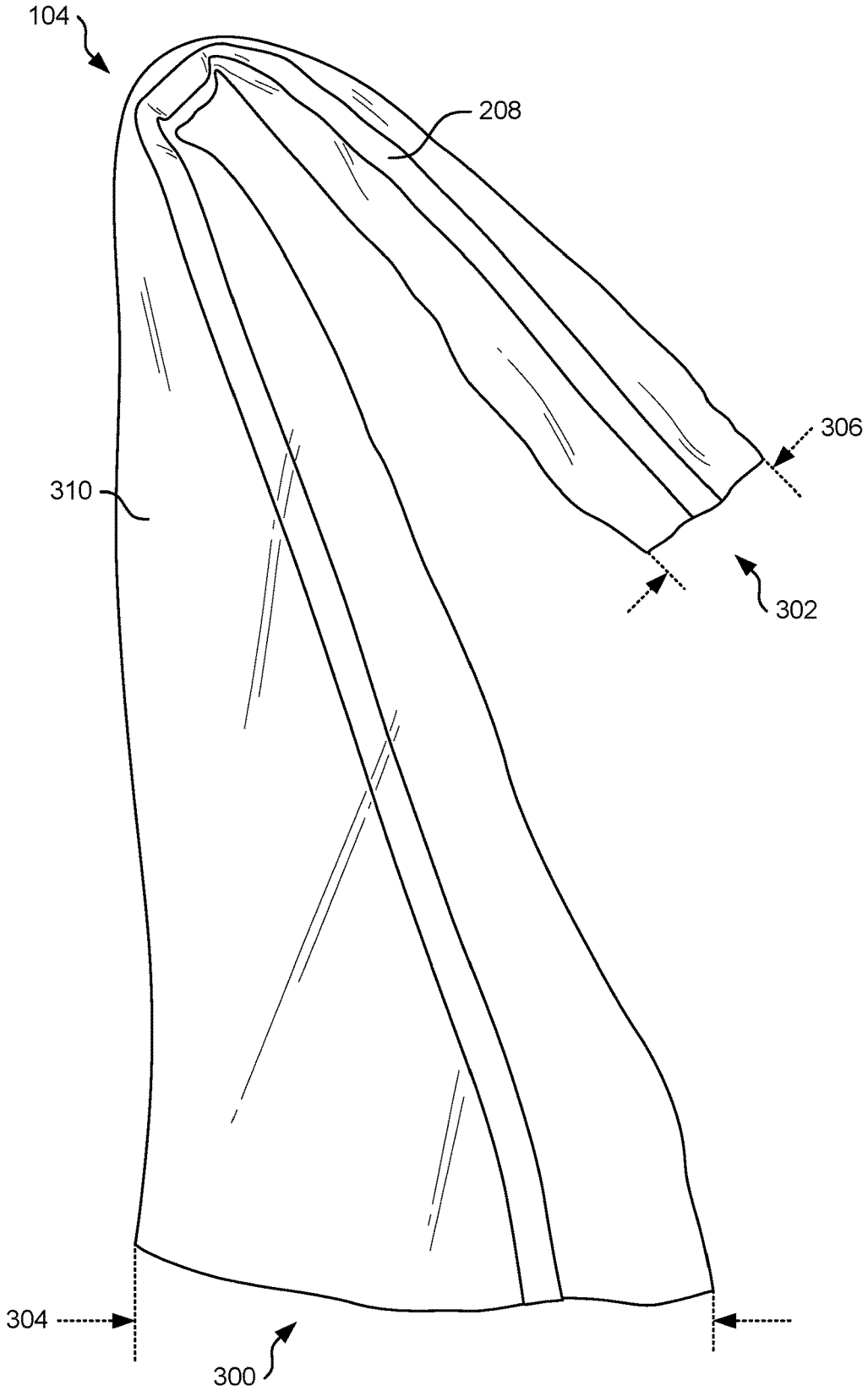
FIG. 3B
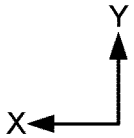

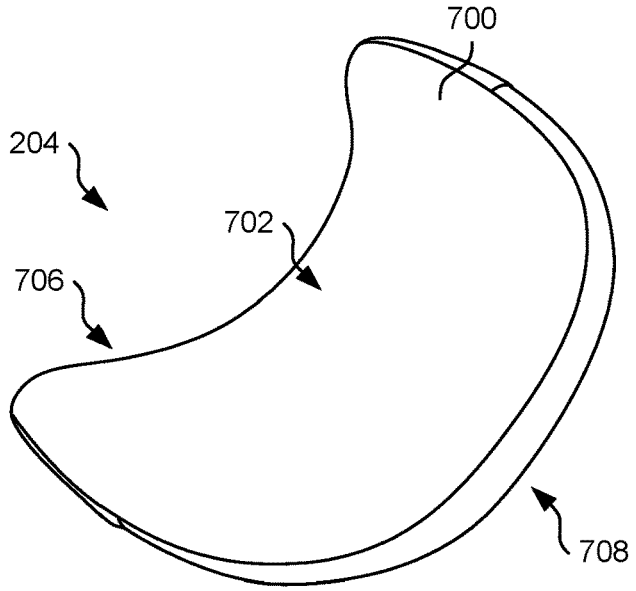
FIG. 7A
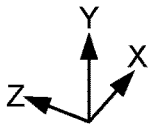
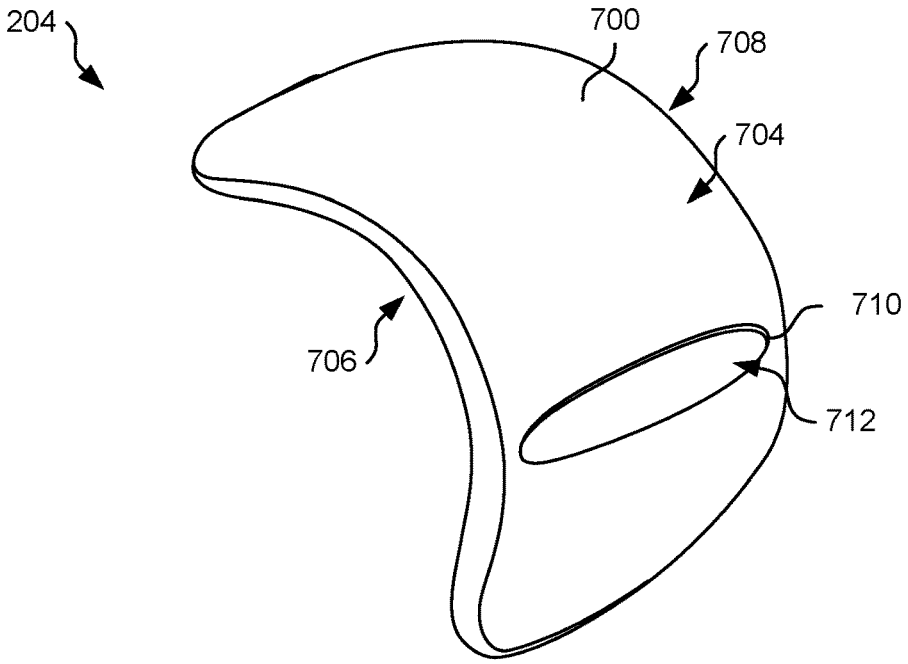
FIG. 7B
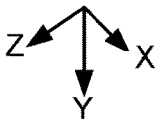

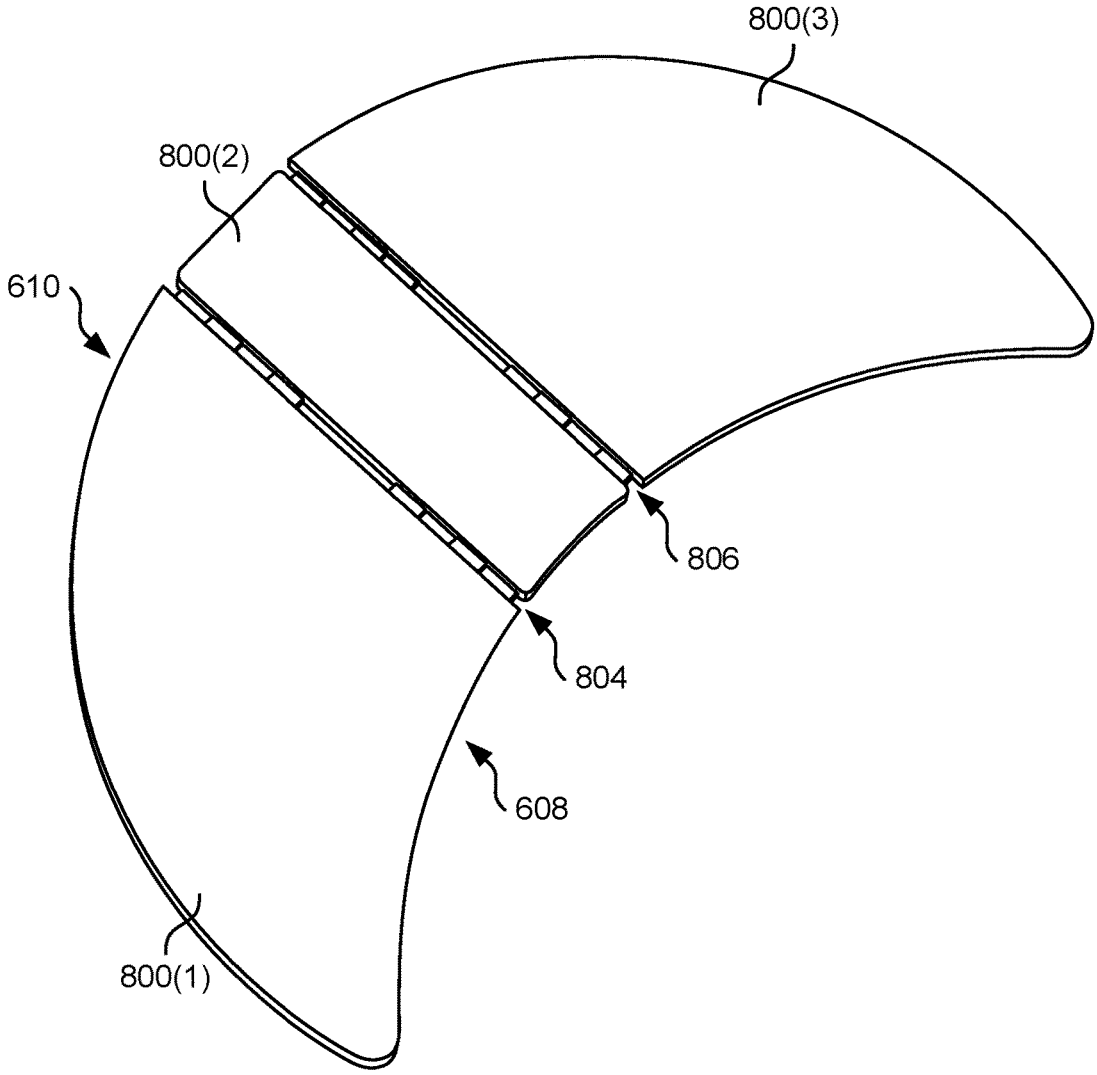
FIG. 10
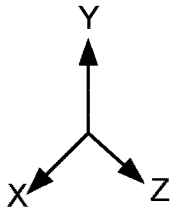

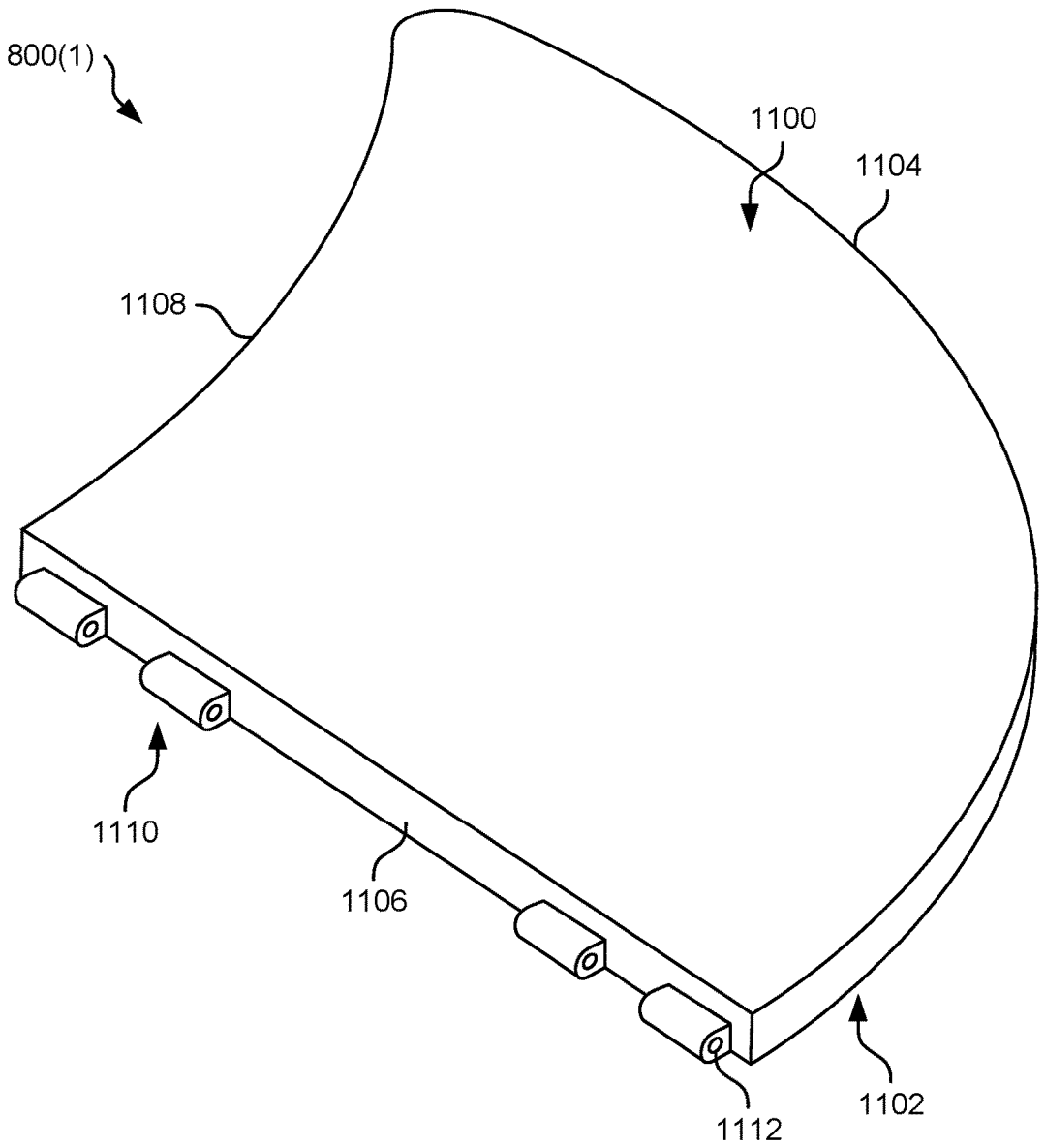
FIG. 11A
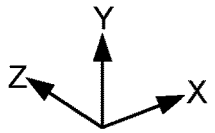

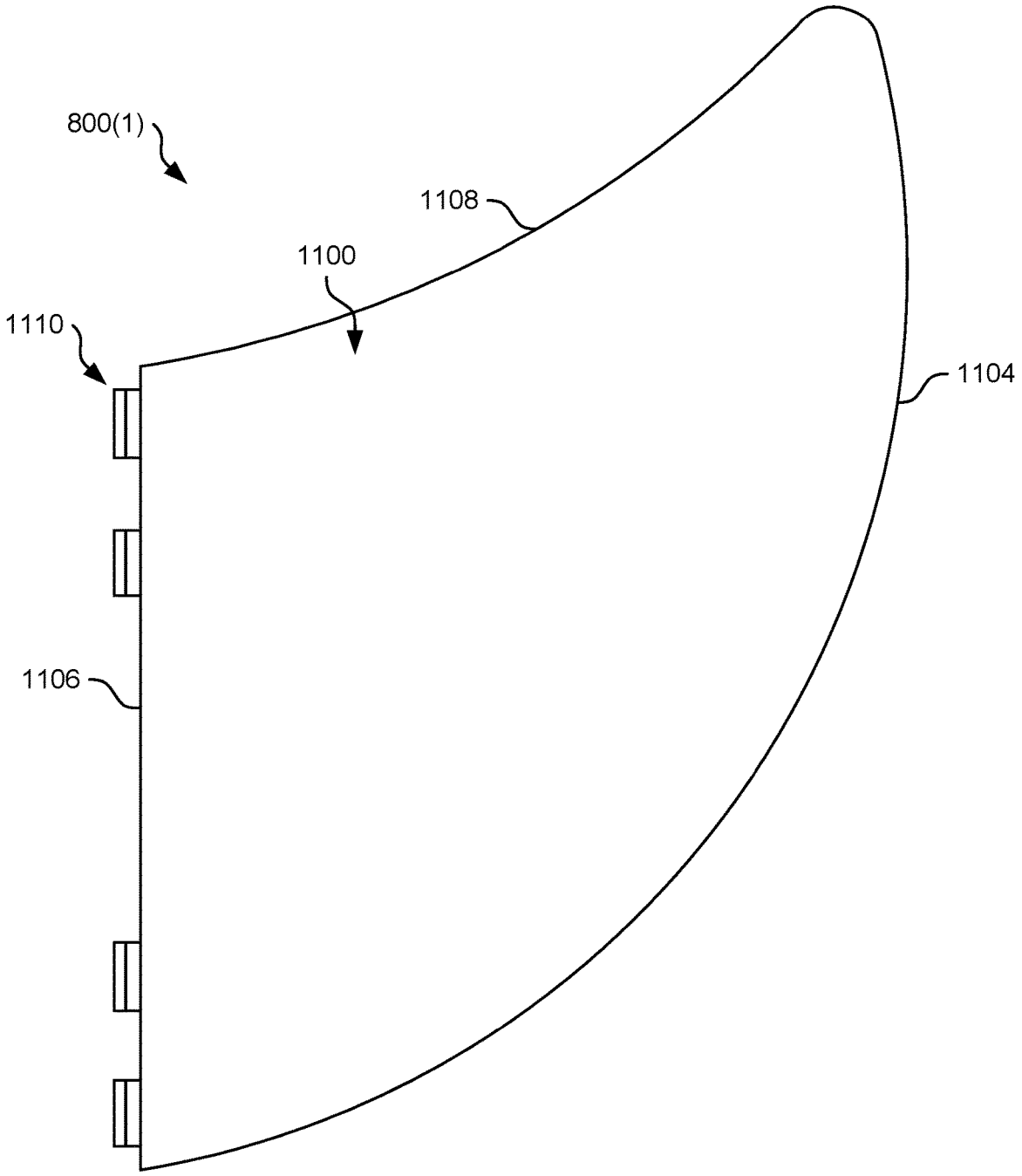
FIG. 11B
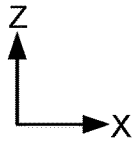

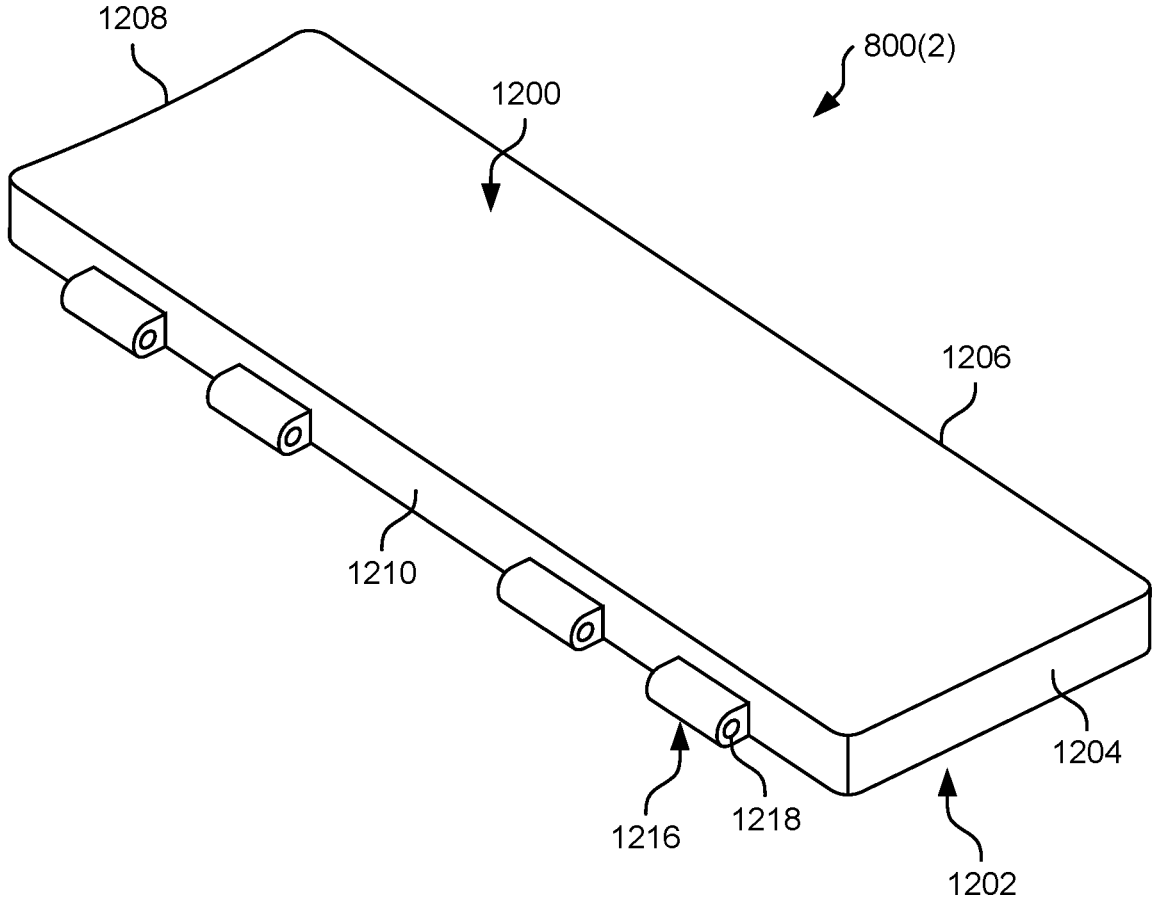
FIG. 12A
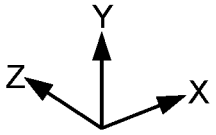

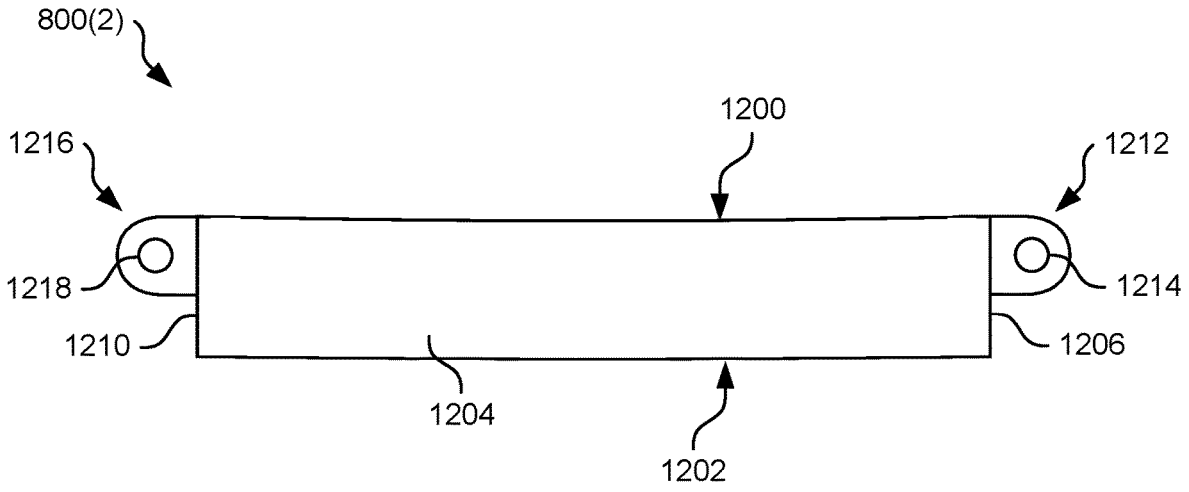
FIG. 12C
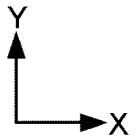

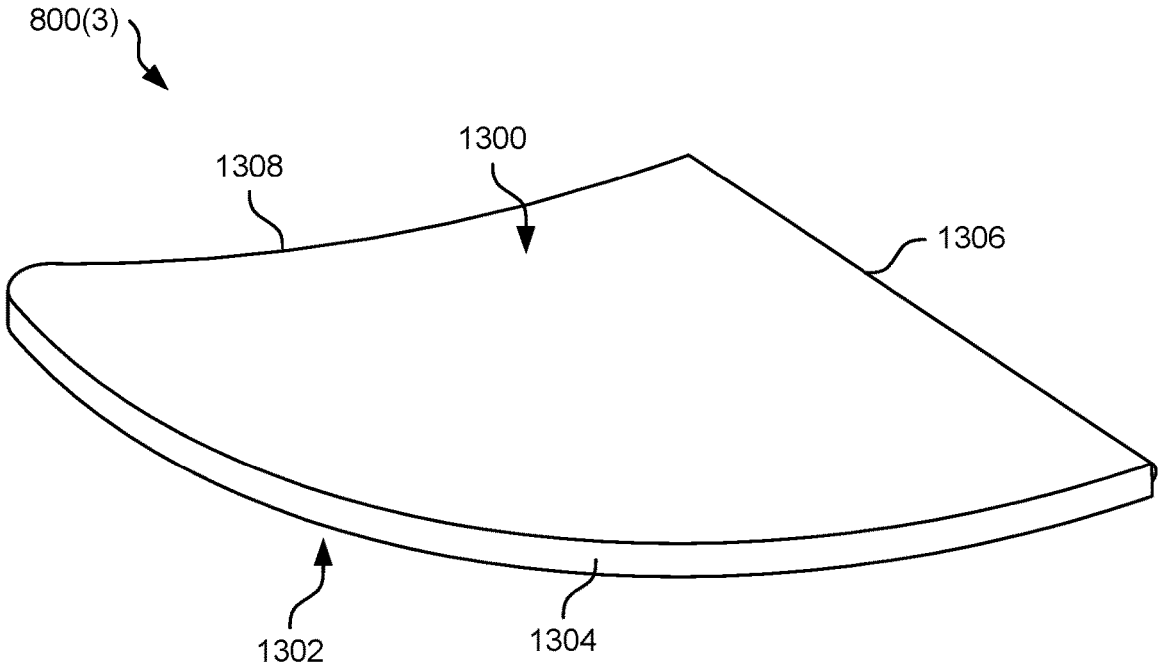
FIG. 13A
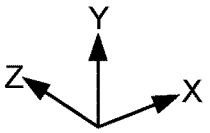

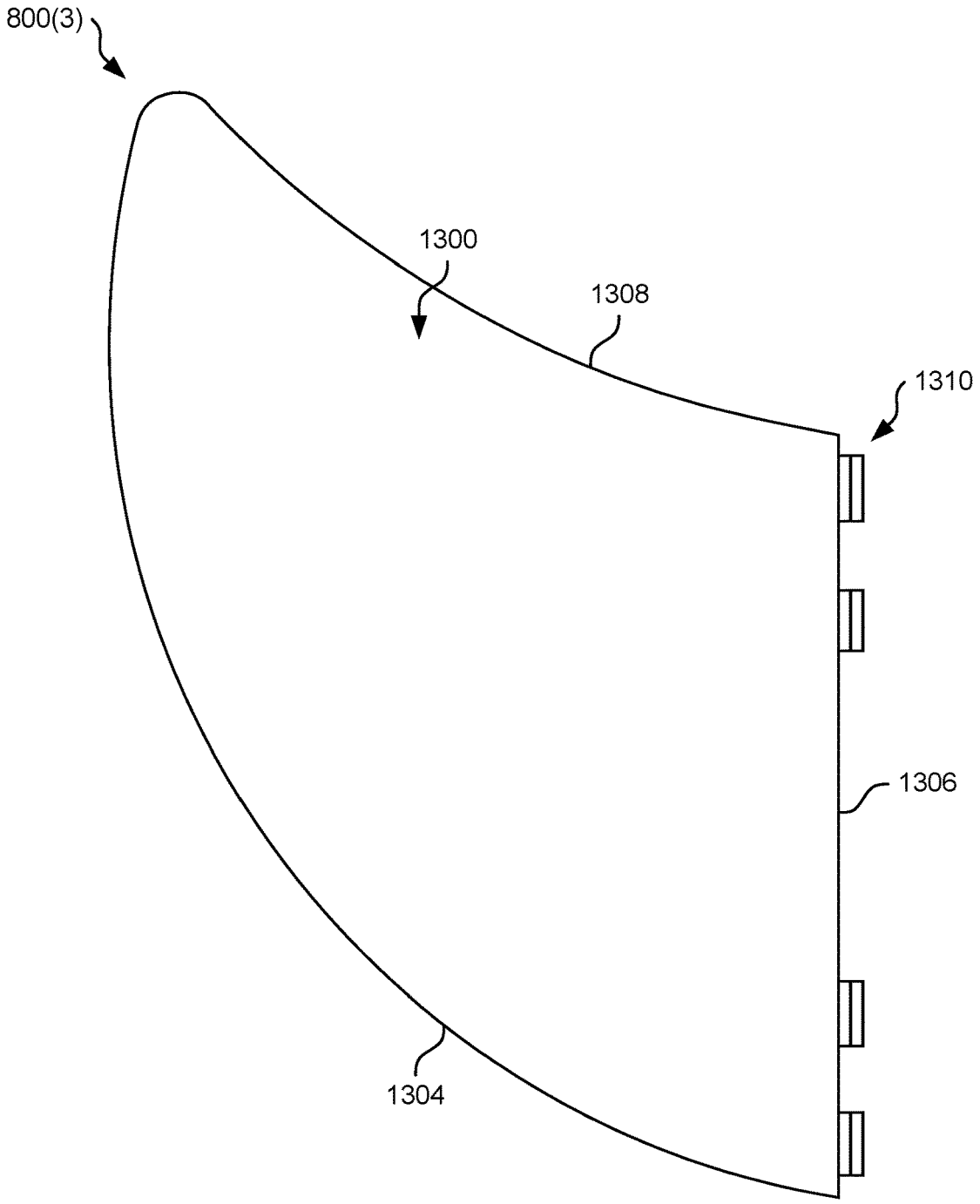
FIG. 13B
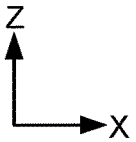

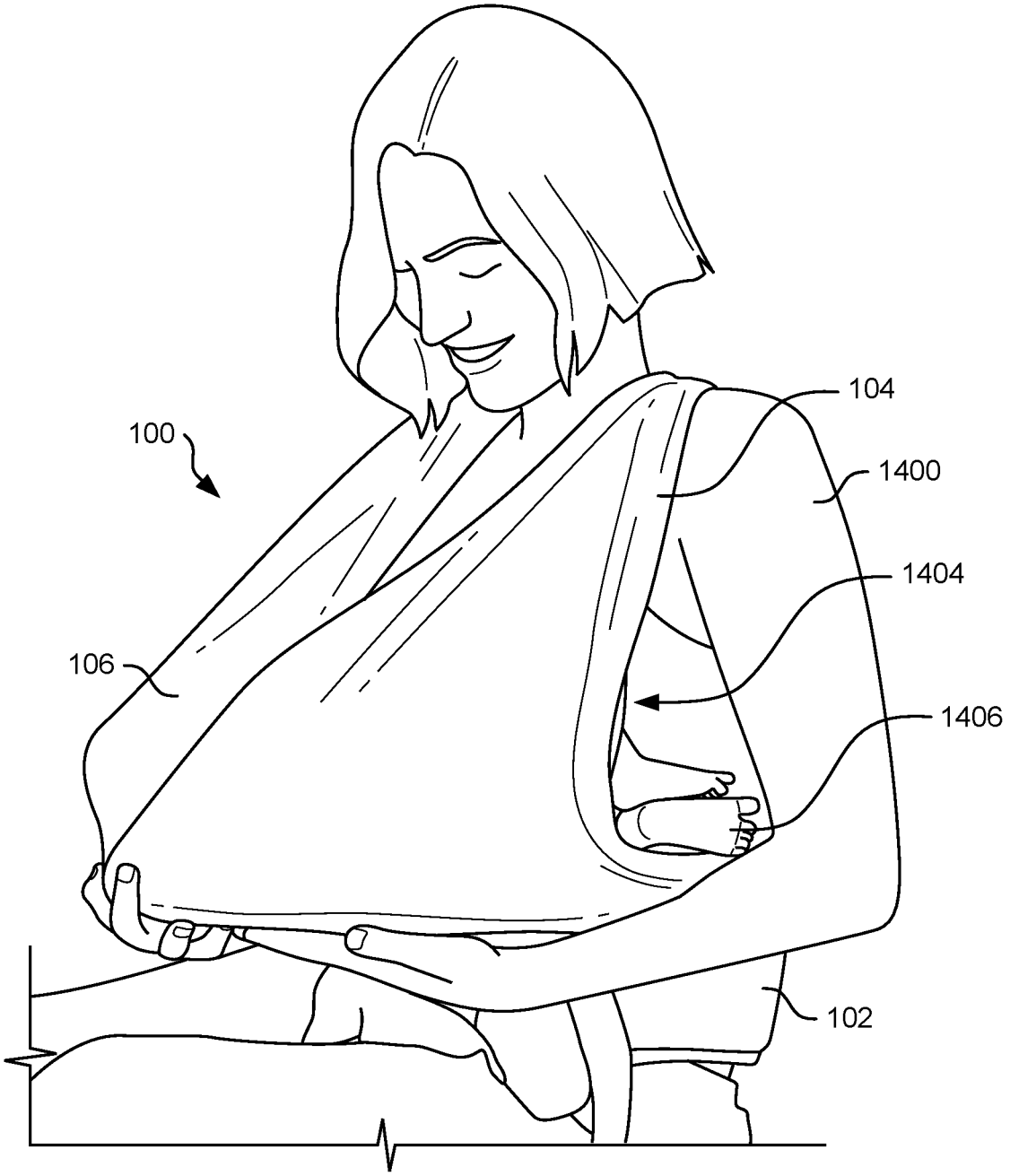
FIG. 14C
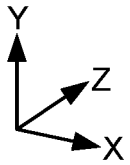

NURSING SLING WITH FOLDABLE PLATFORM

CROSS REFERENCE TO RELATED APPLICATIONS

This application claims priority to U.S. Provisional Application No. 63/369,220, filed Jul. 23, 2022, the entirety of which is herein incorporated by reference.

BACKGROUND

Nursing, or breastfeeding, often requires a mother to sit and support an infant's body and head for extended periods of time, 8-12 times a day in the first 3 months after birth. Holding the body and head of the infant in the nursing position can be complicated, frustrating, uncomfortable, and/or tiresome. Additionally, if the infant is improperly positioned during nursing, the infant may fail to properly latch, swallow, and/or get the nourishment they need. Nursing an infant at all hours of the day alone leads to isolation for the mother, which may increase a likelihood of postpartum depression.

Nursing aids, such as pillows, carriers, nursing covers, and the like, have been developed to assist in nursing both in private (e.g., at home) and in public. However, these devices are often bulky, uncomfortable to wear, require constant readjustment, may not be used until an infant can hold their head up on their own, fail to provide privacy to the infant and/or mother when around other people or in public, are not conveniently transportable, and often lead to improper positioning for nursing.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items. The systems depicted in the accompanying figures are not to scale and components within the figures may be depicted not to scale with each other.

FIGS. 3A and 3B illustrate an example first strap of the nursing sling of FIG. 1, according to examples of the present disclosure.

FIGS. 7A-7C illustrate an example platform and an example cover of the nursing sling of FIG. 1, according to examples of the present disclosure.

FIG. 10 illustrates the platform of FIGS. 7A-7C, showing padding of the platform removed and different sections of the platform, according to examples of the present disclosure.

FIGS. 11A-11C illustrate an example first panel of the platform of FIGS. 7A-7C, according to examples of the present disclosure.

FIGS. 12A-12C illustrate an example second panel of the platform of FIGS. 7A-7C, according to examples of the present disclosure.

FIGS. 13A-13C illustrate an example third panel of the platform of FIGS. 7A-7C, according to examples of the present disclosure.

FIGS. 14A-14C illustrate an example use of the nursing sling of FIG. 1, according to examples of the present disclosure.

DETAILED DESCRIPTION

Figure 1:
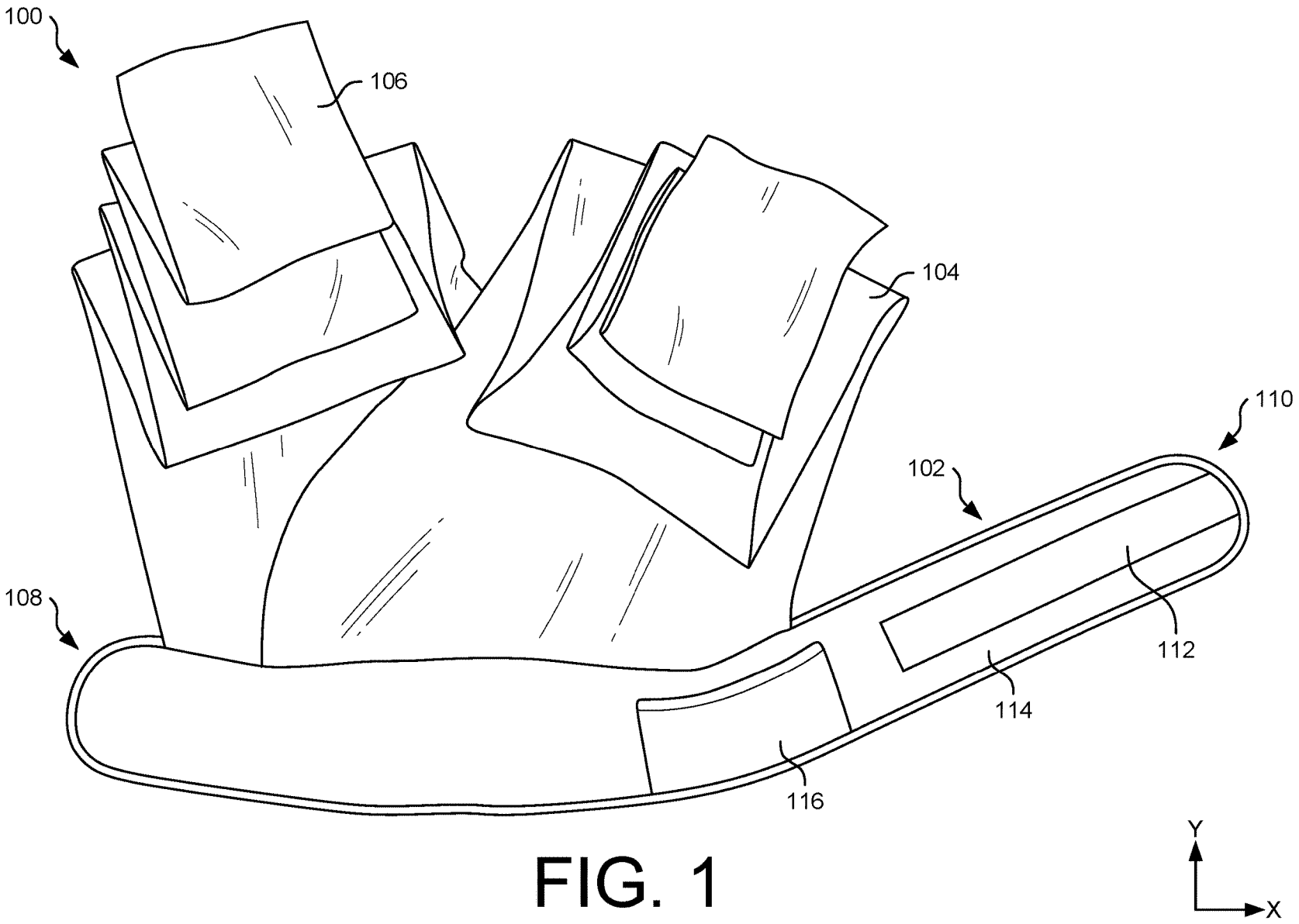
FIG. 1 illustrates a perspective view of a first side of an example nursing sling, according to examples of the present disclosure.

This application is directed, at least in part, to a nursing sling (e.g., apparatus, device, etc.) configured to support an infant and provide privacy to a user during nursing. In some instances, the nursing sling may include a belt to be worn around the waist of the user. A first strap and a second strap may be coupled to the belt for securing the nursing sling around the shoulders and/or back of the user. Moreover, a platform may couple to the belt for supporting the infant. When worn, the platform may abut against the chest, abdomen, stomach, etc. of the user and provide an area for the nursed infant. The first strap and the second strap, in addition to supporting the nursing sling for the user, may provide privacy to the user during nursing. The platform may be configured to transition between a folded state for storage, and an unfolded state for or during use. The nursing sling may therefore provide a portable nursing platform, promote a proper positioning of an infant for nursing, and offer privacy and support for the user.

In some instances, the belt may include a first end and a second end that wrap around the user, such as the waist, stomach, abdomen, etc. of the user. The first end and the second end of the belt may couple together for securing the belt around the user. For example, the first end of the belt may include a first attachment mechanism, such as a hook and loop fastener, and the second end of the belt may include a second attachment mechanism, such as a second hook and loop fastener that secures to the first hook and loop fastener. The belt may be cinched or tightened to various degrees to the user depending upon the coupling of the first hook and loop fastener and the second hook and loop fastener. For example, the first hook and loop fastener may include a length capable of being disposed at varying positions along a length of the second hook and loop fastener.

Although the belt is described as including hook and loop fasteners, the belt may additionally or alternatively include buttons, clips, buckles, ratchets, and the like for securing the belt to the user. In such instances, these additional or alternative attachment/fastening mechanisms may be secured at different locations to adjust the fit, tautness, etc. around the user. Moreover, in some instances, the belt may include pockets for hold item(s) of the user, such as a bottle, pacifier, food, etc.

In some instances, the first strap and the second strap may be sewn to the belt. In some instances, the first strap and the second strap each include a first end sewn to the belt, and an opposite second end. The second ends may be free ends for wrapping around the shoulders and/or back of the user. For example, the second end of the first strap may be routed around a first shoulder of the user, while the second end of the second strap may be routed around a second shoulder of the user. In some instances, the first strap and the second strap may crisscross on/around the back of the user. The first strap and the second strap may also be tied together to secure the nursing sling to the user. In some instances, the first strap and the second strap may be tied together at a location below the platform, and in front of the user. Moreover, the first strap and the second strap may be pulled to varying lengths to adjust tautness. For example, the user may tie the first strap and the second strap at varying positions to tighten and loosen the nursing sling. The amount by which the first strap and the second strap are pulled, and subsequently tightened, may adjust the tilt (e.g., orientation) of the platform. In some instances, however, the first strap and the second strap may be secured together via buckles, buttons, etc. Additionally, or alternatively, although the first strap and the second strap are described as being sewn to the belt, in some instances, the first strap and/or the second strap may be coupled to the belt via zippers, buttons, buckles, and/or other fasteners.

The first strap and the second strap may assist in supporting a weight applied to the platform, or the infant positioned on the platform. For example, the first strap and the second strap may wrap from underneath of the platform, up and around the platform, and over the shoulders of the user. In some instances, the platform includes a first cover, a second cover, and one or more panels that hingedly cover to one another. The first cover may be sewn to the belt for coupling the platform to the belt. However, in some instances, the first cover may be removably coupled to the belt via a zipper, buttons, etc. In some instances, removing the platform from the belt may permit the nursing sling to be used as a carrier (e.g., harness) for carrying the infant (e.g., without the platform). As such, the nursing sling may be used purposes other than nursing.

The first cover may define a compartment for receiving the second cover and the panels. For example, the first cover may include a zipper for providing and restricting access to the second cover and the panels. The first cover may include a waterproof material to prevent liquids, allergens, and/or other debris leaking through and into the compartment (e.g., to prevent soiling the panels and/or padding disposed on the panels).

The second cover may be at least partially disposed around the panels. In some instances, the panels are insertable into the second cover via a slit formed within the second cover. The second cover may include a cushioned material to provide comfort to the user and/or the infant. In some instances, the panels of the platform include various panels, such as a first panel, a second panel, and a third panel. The first panel may hingedly couple to the second panel and the third panel may hingedly couple to the second panel. Here, the second panel may be disposed between the first panel and the third panel. The first panel may couple to a first side of the second panel, while the third panel may couple to a second side of the second panel, opposite the first side. The first panel, the second panel, and the third panel may include knuckles that are coupled together via rods (e.g., pin) for forming hinges and allowing the platform to fold and unfold. For example, a first rod may be disposed through first knuckles of the first panel and second knuckles (along the first side) of the second panel to form a first hinge of the platform, while a second rod may be disposed through third knuckles (along the second side) of the second pane and fourth knuckles of the third panel to form a second hinge of the platform. The hinged coupling may permit the platform to be folded for storage, transportation, etc. For example, in the folded state, the nursing sling may have a reduced footprint and be easily and conveniently packed into carriers (e.g., backpack, carry-ons, etc.), cars, strollers, etc. In the unfolded state, a footprint of the nursing sling may be increased and the panels may provide an area (e.g., platform) upon which the infant lays, rests, and/or otherwise is posited for nursing. In some instances, the platform may have different sizes depending upon the size of the infant, a size of the user, etc. Here, the platform may be interchangeable with other platforms.

In some instances, foam or other padding is disposed on the panels for providing comfort to the infant and/or the user. For example, foam may be disposed on surfaces of the panels that abut, engage, or rest against the user and/or which receive the infant. In some instances, the panels (including the padding adhere thereto) may be disposed within the second cover to further protect from soiling. As noted above, the second cover and the panels may be disposed within the first cover. The padding may include any suitable padding, and in some instances, different portions of the platform may have different thicknesses of padding. For example, different thicknesses of the padding may assist in orienting the infant on their side and/or into the nursing position. Moreover, the padding may include different types or sections of padding having different durometers, characteristics, etc.

In some instances, the first panel, the second panel, and the third panel may define an interior edge and an exterior edge of the platform. The interior edge may be oriented towards (e.g., face) the user, while the exterior edge may be oriented towards (e.g., face) away from the user. The exterior edge may be spaced apart from the user. In some instances, the interior edge curves between the first panel and the third panels so as to follow a contour or shape of a ribcage, chest, abdomen, etc. of the user. In other words, the first panel, the second panel, and the third panel may form the curved interior edge. In some instances, the exterior edge may follow a curvature of the interior edge. Padding may be disposed on the interior edge and/or the exterior edge. When worn, the first strap and the second strap may wrap from underneath the platform, around or over the exterior edge, and then over the shoulders of the users.

The nursing sling may be manufactured from washable, breathable, or other materials. For example, the nursing sling, or components thereof, such as the belt, slings, etc. may be manufactured from bamboo knit fabric, polyester, cotton, etc. The padding may be manufactured from polyester, polyurethane, expanded polyethylene foam, etc. The nursing sling, or components thereof, may be machine washable.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates a front view of an example nursing sling 100, according to examples of the present disclosure. In some instances, the nursing sling 100 may include a belt 102, a first strap 104, and a second strap 106. The belt 102 is configured to be wrapped around a user wearing the nursing sling 100. For example, the belt 102 may include a first end 108 and a second end 110 spaced apart from the first end 108 (e.g., in the X-direction). The belt 102 may include a first attachment mechanism 112 disposed at, or proximate to, the second end 110. Additionally, as will be explained herein, a second attachment mechanism may be disposed at, or proximate to, the first end 108. The first attachment mechanism 112 may be configured to secure to the second attachment mechanism for securing the belt 102 (and therefore the nursing sling 100) to the user. For example, the belt 102 may be wrapped around a waist, hip, or abdomen of the user. The first attachment mechanism 112 and/or the second attachment mechanism may include hook and loop fasteners, buttons, buckles, etc. for securing the belt 102 to the user. The first attachment mechanism 112 and the second attachment mechanism may be coupled at various locations to tighten and loosen the belt 102 to and from the user, respectively. The first attachment mechanism 112 may be disposed on a first side 114 of the belt 102, while the second attachment mechanism may be disposed on a second side of the belt 102, opposite the first side 114 (e.g., in the Z-direction).

As will be explained herein, the first strap 104 and the second strap 106 may be coupled (e.g., sewn) to the belt 102. The first strap 104 and the second strap 106 may include a length for wrapping around the user, such as the shoulder, back, over the clavicles, etc. The first strap 104 and the second strap 106 are shown in a semi-folded state in FIG. 1. As will be explained herein, the first strap 104 and the second strap 106 may be pulled taut over a platform of the nursing sling 100 and up around the shoulders once the belt 102 is worn by the user. The first strap 104 and the second strap 106 may be crossed in the back of the user, and tied around the waist in front. Once on the user, the infant may be laid on the platform with their head facing either right or left.

The belt 102 may further include a pocket 116 formed in, or coupled to, the belt 102 on the first side 114. The pocket 116, for example, may hold item(s) of the user and/or the infant (e.g., pacifier, food, water bottle, keys, phone, etc.).

Figure 2A:
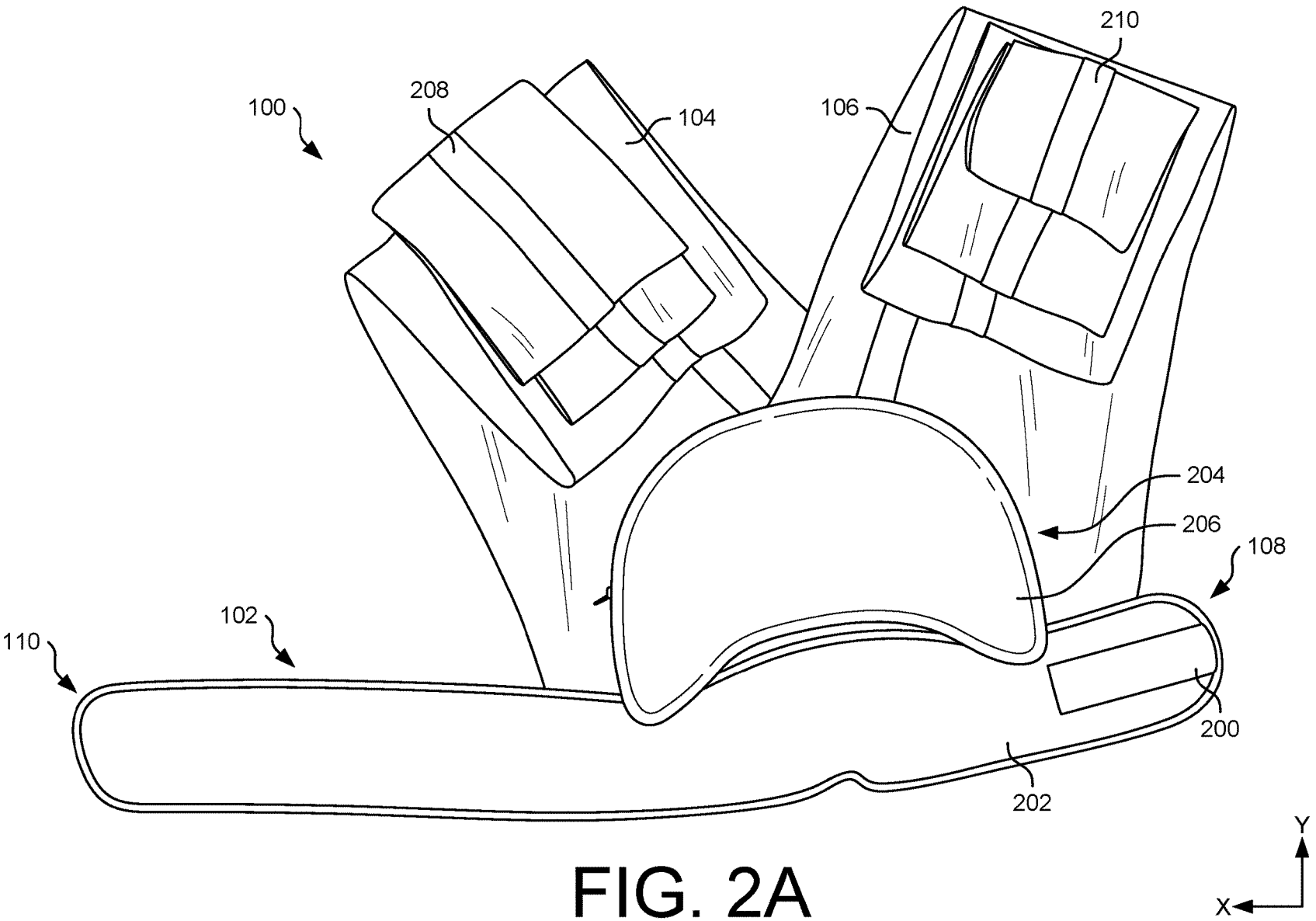
FIG. 2A illustrates a perspective view of a second side of the nursing sling of FIG. 1, showing a first position of an example platform of the nursing sling, according to examples of the present disclosure.
Figure 2B:
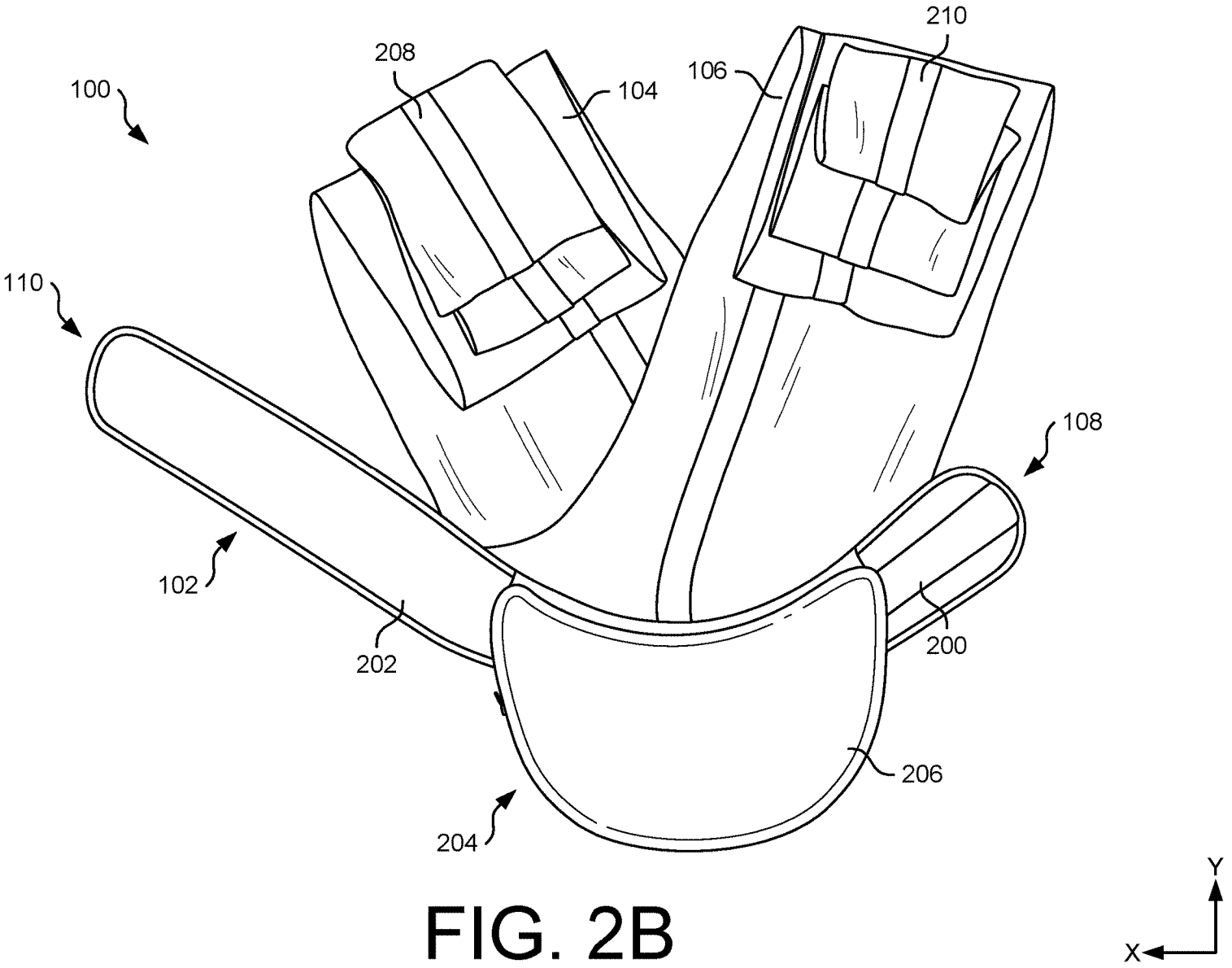
FIG. 2B illustrates a perspective view of the second side of the nursing sling of FIG. 1, showing a second position of the platform of the nursing sling, according to examples of the present disclosure.
Figure 2C:
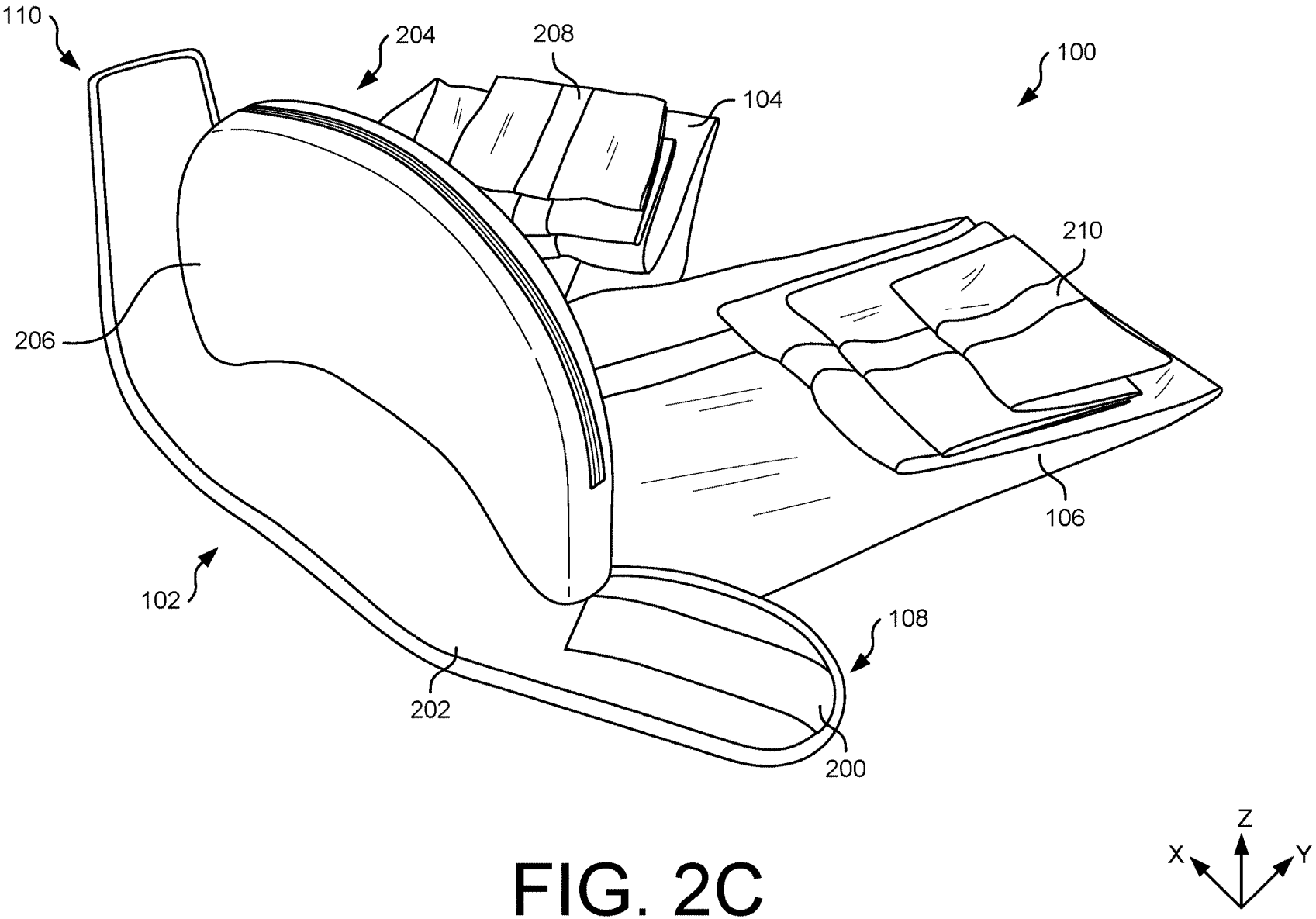
FIG. 2C illustrates a perspective view of the second side of the nursing sling of FIG. 1, showing a third position of the platform of the nursing sling, according to examples of the present disclosure.

FIGS. 2A-2C illustrate a rear view of the nursing sling 100, according to examples of the present disclosure. As introduced above, the belt 102 includes a second attachment mechanism 200 disposed on a second side 202 of the belt 102. When worn, the second side 202 of the belt 102 may be oriented towards (e.g., face) the user, while the first side 114 of the belt 102 may be oriented (e.g., face) away from the user. To couple the belt 102 to the user, the first end 108 of the belt 102 may be wrapped around the second end 110 of the belt 102. In doing so, the second attachment mechanism 200 may couple to the first attachment mechanism 112.

The nursing sling 100 may further include a platform 204 for supporting an infant. Details of the platform 204 are disposed herein, however, the platform 204 may include a first cover 206 coupled (e.g., sewn) to the belt 102. Alternatively, in some instances, the first cover 206 may be removably coupled to the belt 102 via a zipper, buttons, etc. In some instances, removing the platform 204 from the belt 102 may permit the nursing sling 100 to be used as a sling (e.g., harness) for carrying the infant (e.g., without the platform 204).

A second cover and panel(s) of the platform 204 may reside within the first cover 206. The first cover 206 may be waterproof to prevent liquid, allergens, debris, etc. permeating into the platform 204. The first cover 206 may couple to belt 102 and may be configured to hinge about such coupling. For example, as shown in FIG. 2A, the platform 204 may be a first position, in FIG. 2B, the platform 204 may be in a second position, and in FIG. 2C, the platform 204 may be in a third position. In some instances, the hinged coupling permits the platform to be fitted to the user to increase a comfort when using the nursing sling 100. In FIGS. 2A-2C, the platform is shown in an unfolded state. However, as will be explained herein, the platform 204 (e.g., the first cover 206, the second cover, and the panels) may be folded for storage, transportation, etc.

As introduced above, the first strap 104 and the second strap 106 may be coupled to the belt 102. The first strap 104 may include a first band 208 to provide strength, support, etc. to the first strap 104, while the second strap 106 may include a second band 210 to provide strength, support, etc. to the second strap 106.

FIGS. 3A and 3B illustrate the first strap 104, according to examples of the present disclosure. The first strap 104 includes a length that extends between a first end 300 and a second end 302 (e.g., in the Y-direction). The first end 300 may couple to the belt 102, while the second end 302 may be free for tightening to the second strap 106. The first end 300 of the first strap 104 includes a first width 304 (e.g., dimension in the X-direction), while the second end 302 of the first strap 104 includes a second width 306 (e.g., dimension in the X-direction). The first width 304 may be greater than the second width 306. In some instances, and as will be explained herein, the first width 304 may be greater in order to provide privacy to the user and/or the infant within the nursing sling 100. Additionally, the greater width of the first end 300 may assist in supporting the platform 204. As such, a width of the first strap 104 may taper between the first end 300 and the second end 302.

The first strap 104 may include a first side 308 and a second side 310 opposite the first side 308 (e.g., in the Z-direction). The first band 208 may be coupled (e.g., sewn) to the second side 310, which may be oriented towards the user. In some instances, the first end 300 of the first strap 104 may be sewn to the belt 102, or may be coupled to the belt 102 via zippers, buttons, buckles, and/or other fasteners.

Figure 4A:
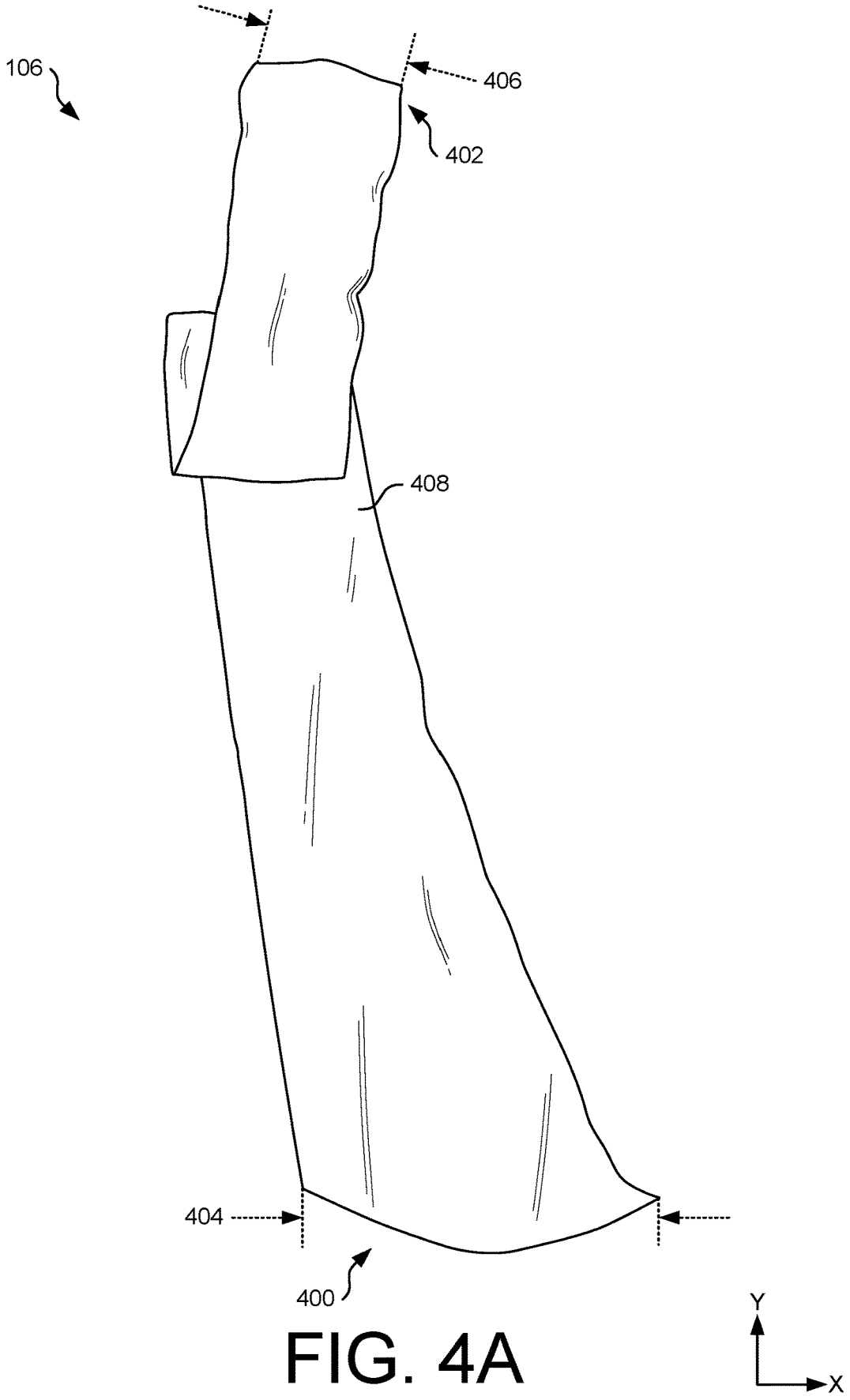
FIGS. 4A and 4B illustrate an example second strap of the nursing sling of FIG. 1, according to examples of the present disclosure.
Figure 4B:
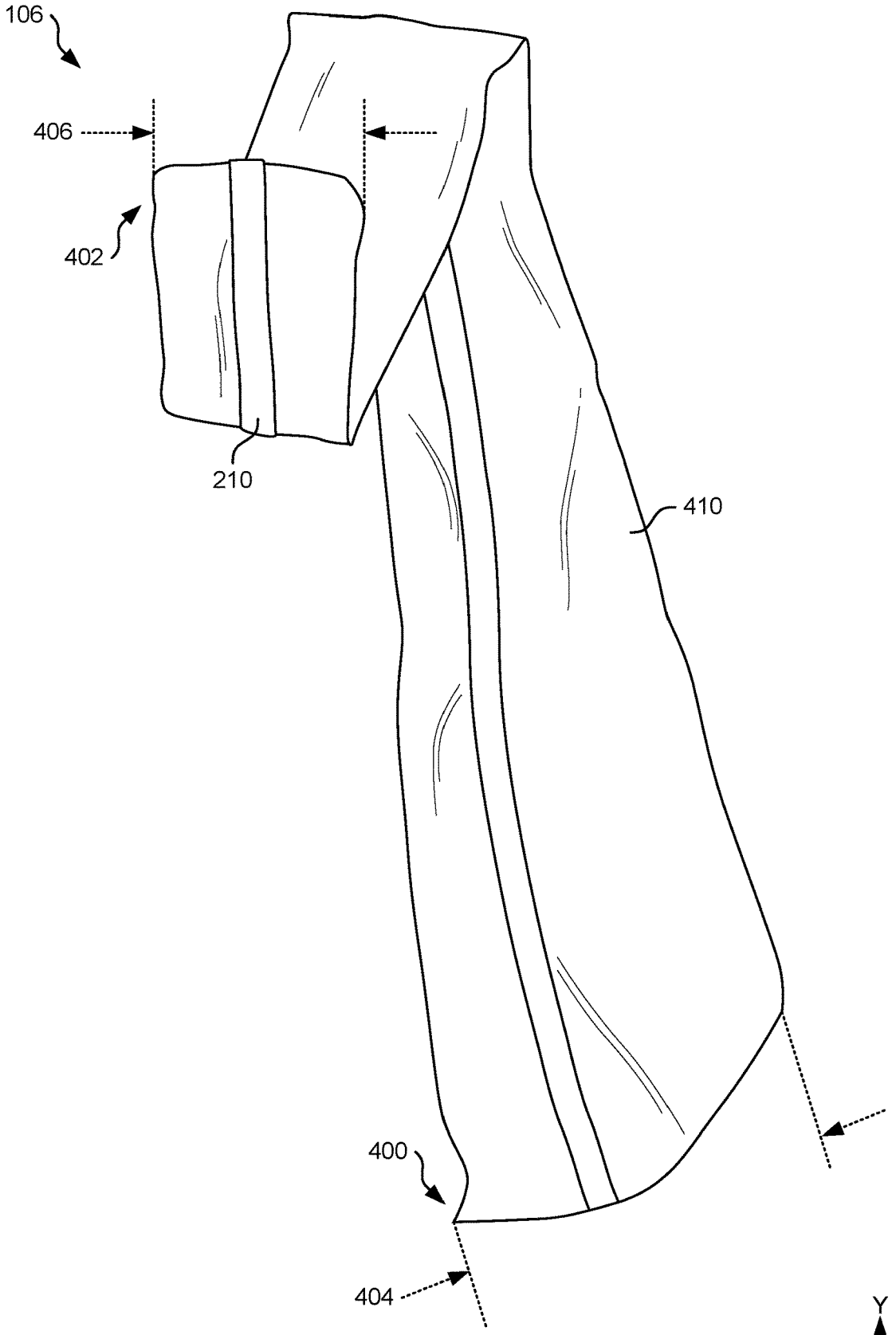

FIGS. 4A and 4B illustrate the second strap 106, according to examples of the present disclosure. The second strap 106 includes a length that extends between a first end 400 and a second end 402 (e.g., in the Y-direction). The first end 400 may couple to the belt 102, while the second end 402 may be free for tightening to the first strap 104. The first end 400 of the second strap 106 includes a first width 404 (e.g., dimension in the X-direction), while the second end 402 of the second strap 106 includes a second width 406 (e.g., dimension in the X-direction). The first width 404 may be greater than the second width 406. In some instances, and as will be explained herein, the first width 404 may be greater in order to provide privacy to the user and/or the infant within the nursing sling 100. Additionally, the greater width of the first end 400 may assist in supporting the platform 204. As such, a width of the second strap 106 may taper between the first end 400 and the second end 402.

The second strap 106 may include a first side 408 and a second side 410 opposite the first side 408 (e.g., in the Z-direction). The second band 210 may be coupled (e.g., sewn) to the second side 410, which may be oriented towards the user. In some instances, the first end 400 of the second strap 106 may be sewn to the belt 102, or may be coupled to the belt 102 via zippers, buttons, buckles, and/or other fasteners.

Figure 5A:
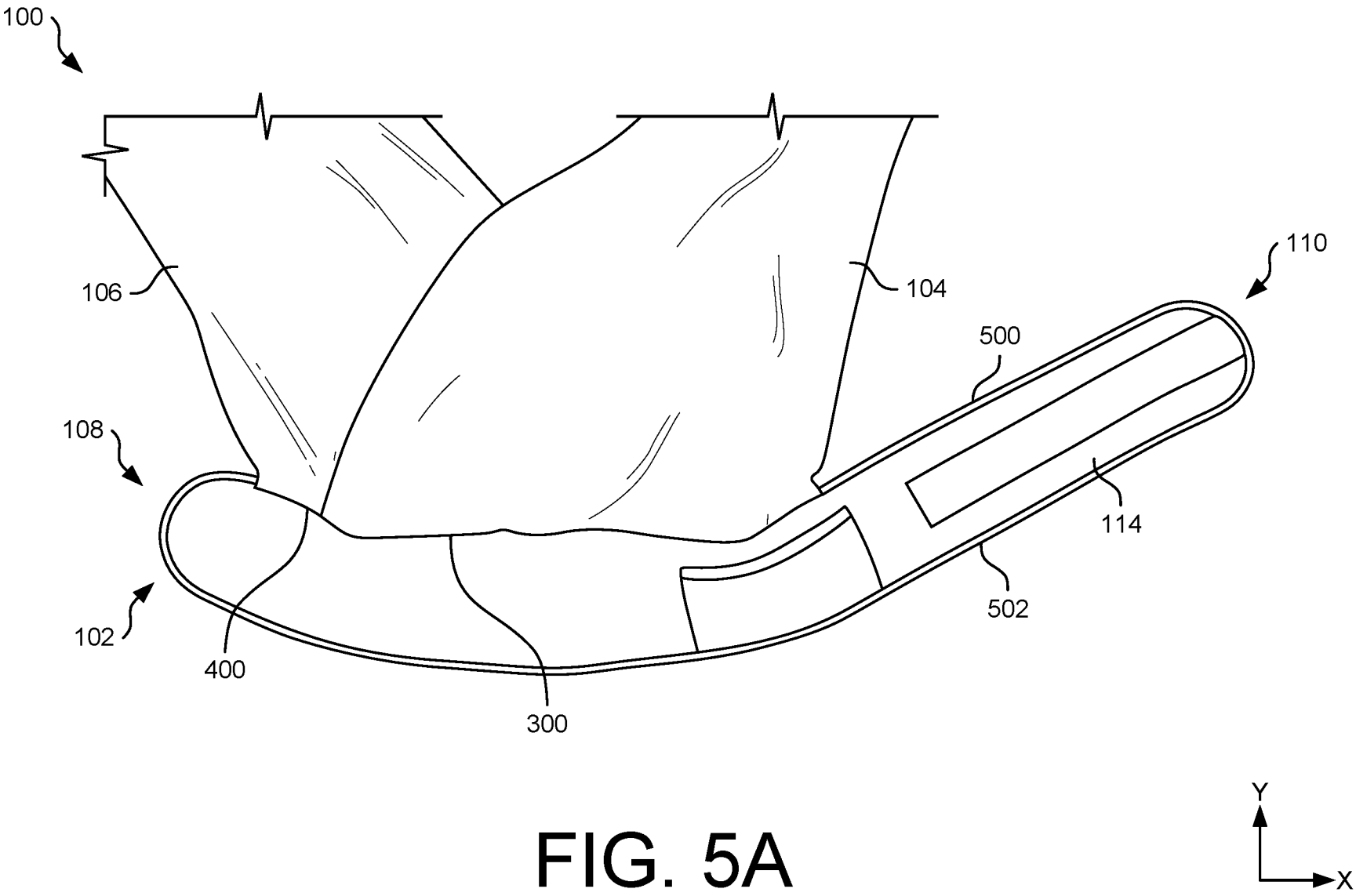
FIGS. 5A and 5B illustrate the first strap of FIGS. 3A and 3B, and the second strap of FIGS. 4A and 4B coupled to an example belt of the nursing sling of FIG. 1, according to examples of the present disclosure.
Figure 5B:
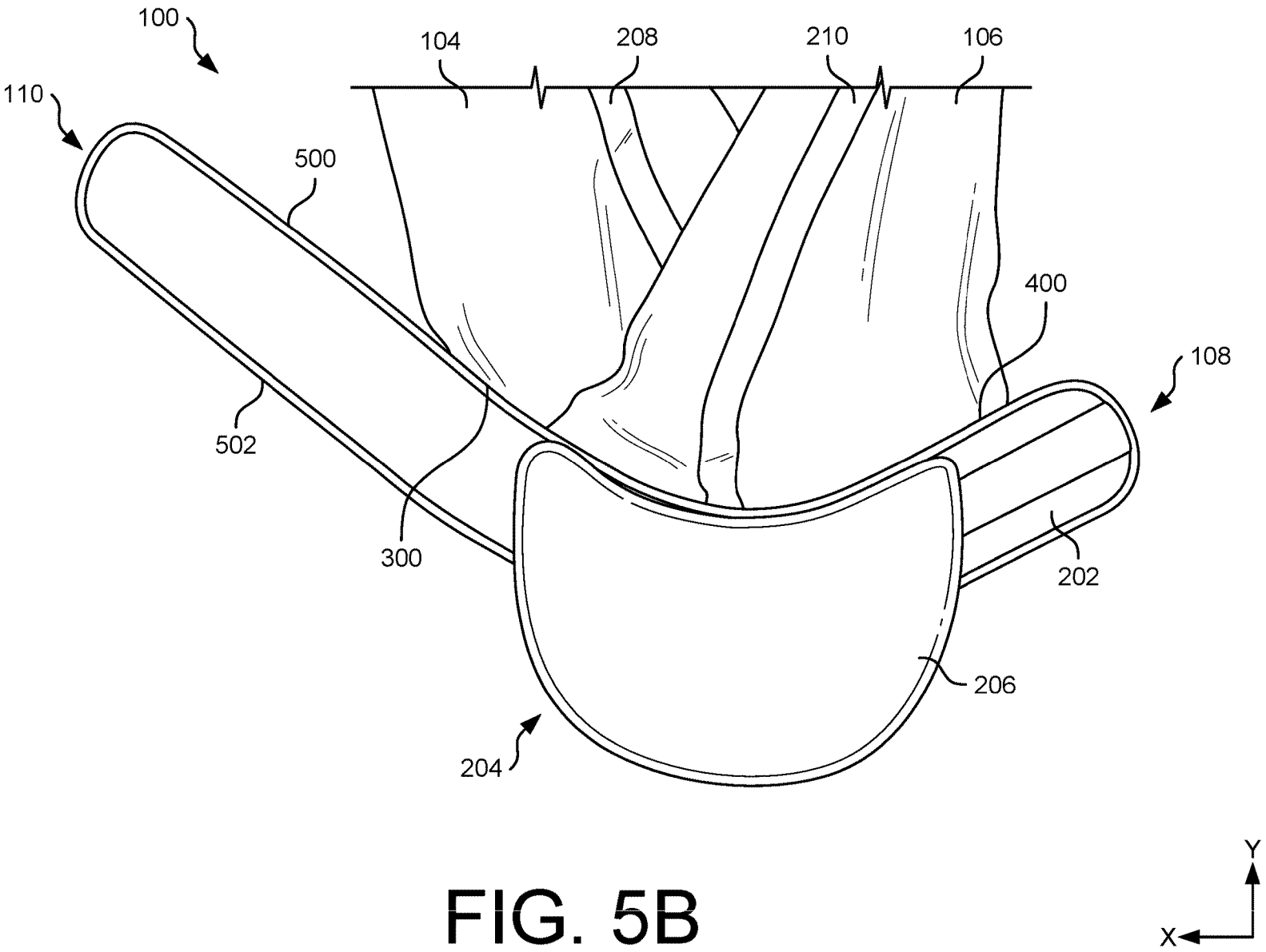

FIGS. 5A and 5B illustrate a coupling of the first strap 104 and the second strap 106 to the belt 102, according to examples of the present disclosure. In some instances, the first strap 104 and the second strap 106 may couple to a top 500 of the belt 102, opposite a bottom 502 of the belt 102 (e.g., in the Y-direction). For example, the first end 300 of the first strap 104 and the first end 400 of the second strap 106 may couple to the top 500 of the belt 102. In some instances, the first strap 104 and the second strap 106 may couple more proximate to the first end 108 of the belt 102 than the second end 110 of the belt 102.

As shown, the first strap 104 may be disposed over at least a portion of the second strap 106. For example, the first strap 104 may be disposed in front of the second strap 106, or the second strap 106 may be disposed behind the first strap 104, proximate to the first end 300 and the first end 400. The overlapping of the first strap 104 and the second strap 106 may provide privacy to the user, the infant, and/or assist in providing support to the platform 204. In this sense, the first strap 104 may be wrapped over a portion of the second strap 106. Stated alternatively, in some instances, the second strap 106 may be disposed more proximate to the second side 202 of the belt 102 than the first strap 104, while the first strap 104 may be disposed more proximate to the first side 114 of the belt 102 than the second strap 106. The first cover 206 may additionally or alternatively be coupled to the top 500 of the belt 102.

Figure 6A:
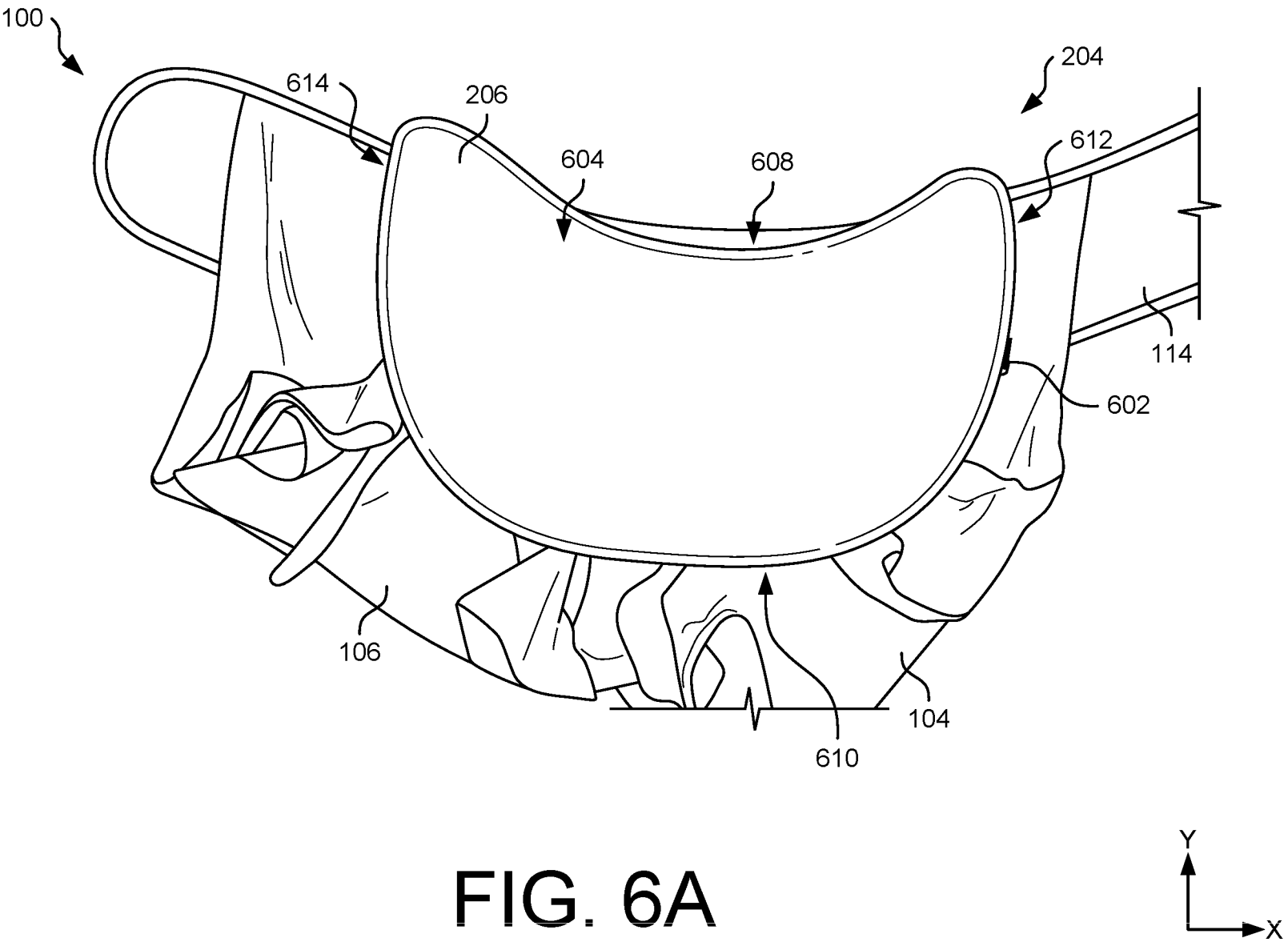
FIGS. 6A-6D illustrate an example platform of the nursing sling of FIG. 1, according to examples of the present disclosure.
Figure 6B:
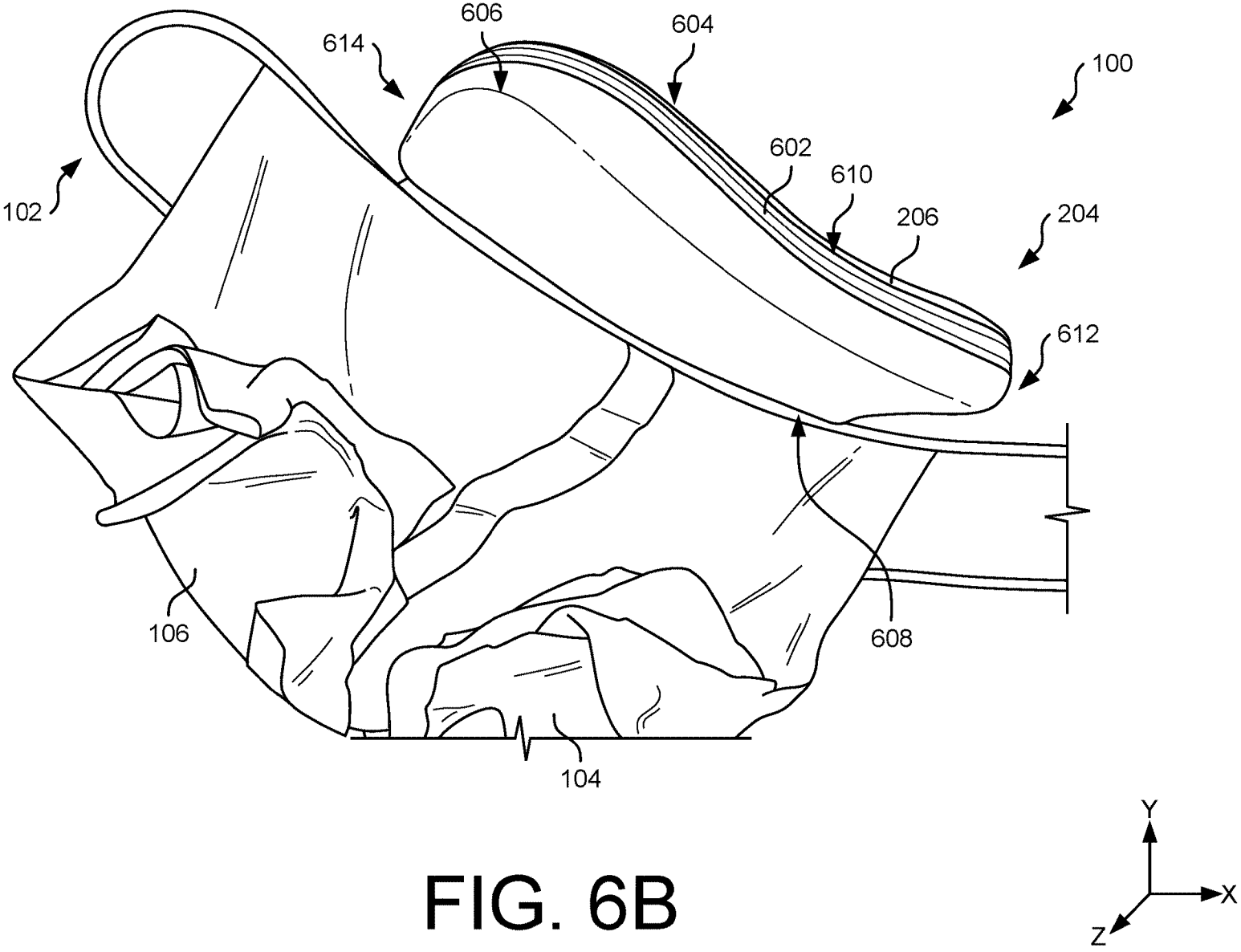
Figure 6C:
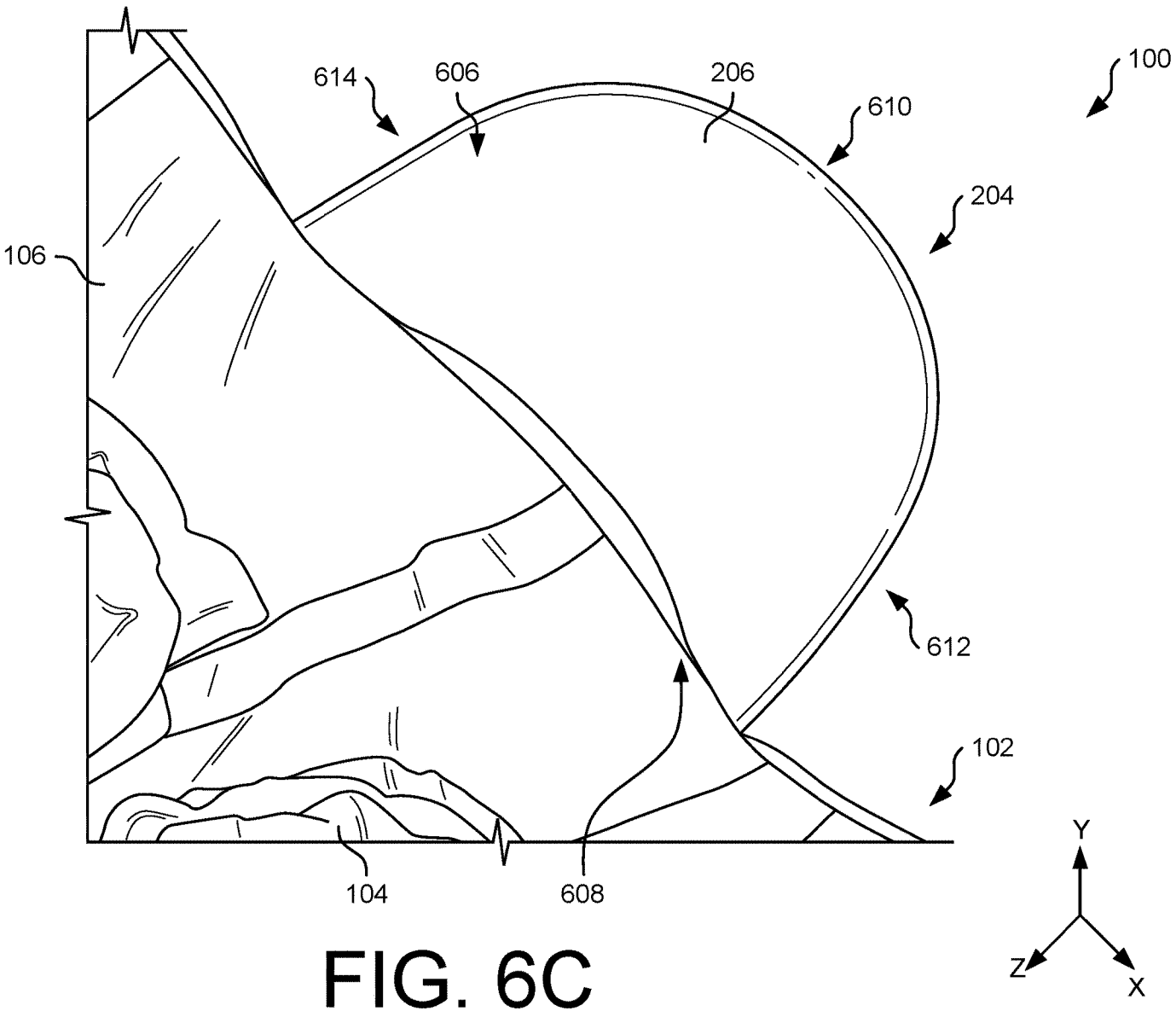
Figure 6D:
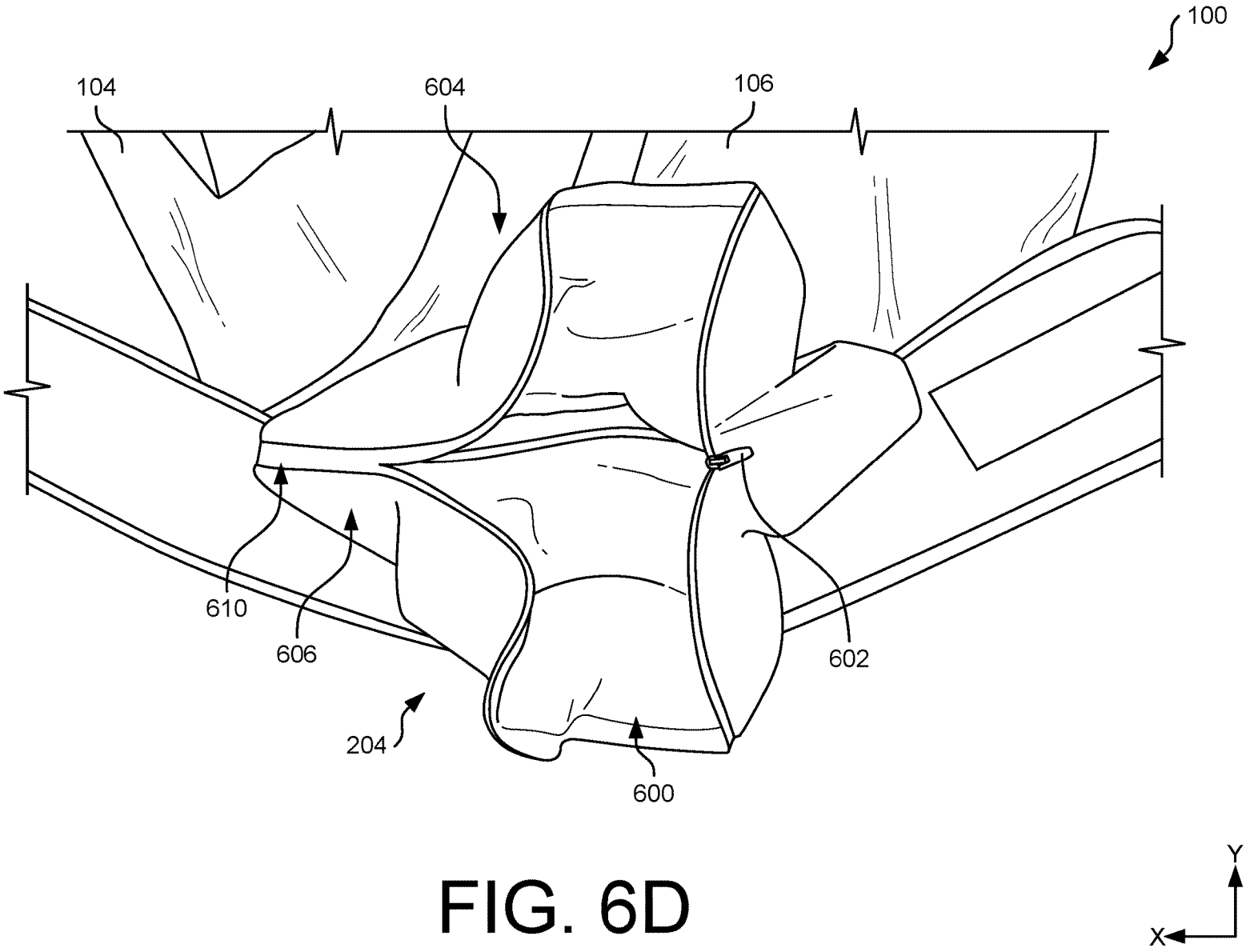

FIGS. 6A-6D illustrate the platform 204 of the nursing sling 100, according to examples of the present disclosure. As introduced above, the platform 204 may include the first cover 206, as well as a second cover and panel(s) that reside within the first cover 206. The first cover 206 is shown being closed in FIGS. 6A-6C, while in FIG. 6D, the first cover 206 is shown being opened. More particularly, the first cover 206 may define a compartment 600 that is accessible via a zipper 602, for example. That is, in FIGS. 6A-6C, the zipper 602 may be closed to enclose the second cover and the panel(s) within the compartment 600, while in FIG. 6D, the zipper 602 may be opened to provide access to the compartment. In FIG. 6D, the second cover and the panel(s) are shown being removed from the compartment 600.

The platform 204 may include a top surface 604 and a bottom surface 606 opposite the top surface 604 (e.g., in the Y-direction). The top surface 604 and the bottom surface 606 may be defined by the first cover 206. During use, the infant may be placed on, or rested on, the top surface 604. In some instances, the first strap 104 and the second strap 106 couple to the belt 102 at a location below the bottom surface 606. As such, when secured to the user, the first strap 104 and the second strap 106 may wrap over the platform 204 (e.g., from beneath the bottom surface 606) to be disposed over the shoulders of the user.

The platform 204 may also include an interior edge 608 and an exterior edge 610 (e.g., spaced apart in the Z-direction). The interior edge 608 may abut the user, while the exterior edge 610 may be spaced apart from the user. The interior edge 608 may couple to the belt 102. As shown, the interior edge 608 may curve between a first side 612 of the platform 204 and a second side 614 of the platform 204 (e.g., in the X-direction). The curved nature of the interior edge 608 may conform to a contour of the rib cage, chest, abdomen, etc. of the user. Additionally, or alternatively, the exterior edge 610 may include a similar or different curvature than the interior edge 608. The zipper 602 may extend along at least a portion of the exterior edge 610, from the first side 612 to the second side 614. As indicated above, the first strap 104 and the second strap 106, when the nursing sling 100 is fastened to the user, may be disposed at least partially over the exterior edge 610. In doing so, the first strap 104 and the second strap 106 may engage with the bottom surface 606 and/or the exterior edge 610 to support a weight of the infant. In some instances, the nursing sling 100 may be used for nursing infants up to ages of two, and/or may be used for infants up to twenty pounds in weight. However, the nursing sling 100 may be used for infants of a greater age and/or weight. In some instances, to keep the platform 204 upright, the first strap 104 and the second strap 106 may engage with the bottom surface 606 and/or the exterior edge 610. Tightening or loosening the first strap 104 and/or the second strap 106 may adjust a position of the platform 204 (e.g., about the X-axis) to be flat, angled, etc. When worn, the exterior edge 610 may be spaced apart from the first side 114 of the belt 102, or stated alternatively, the exterior edge 610 may be disposed away from the first side 114 of the belt 102.

In some instances, the platform 204 may be interchangeable with other platforms. For example, depending upon the size of the infant and/or the user, a particular platform with a certain size, shape, etc. may be used with the nursing sling 100. For example, to replace the platform 204, the zipper 602 may be undone and a platform 204 with the desired characteristics may be placed inside the compartment 600. In such instances, the panel(s) of the platform 204 may have different shapes and sizes. Examples widths of the platform 204, for example, include twelve inches, fourteen inches, twenty four inches, etc., and/or example depths of the platform 204 inch six inches, eight inches, ten inches, twelve inches, etc. However, other widths and/or depths are envisioned.

Figure 7C:
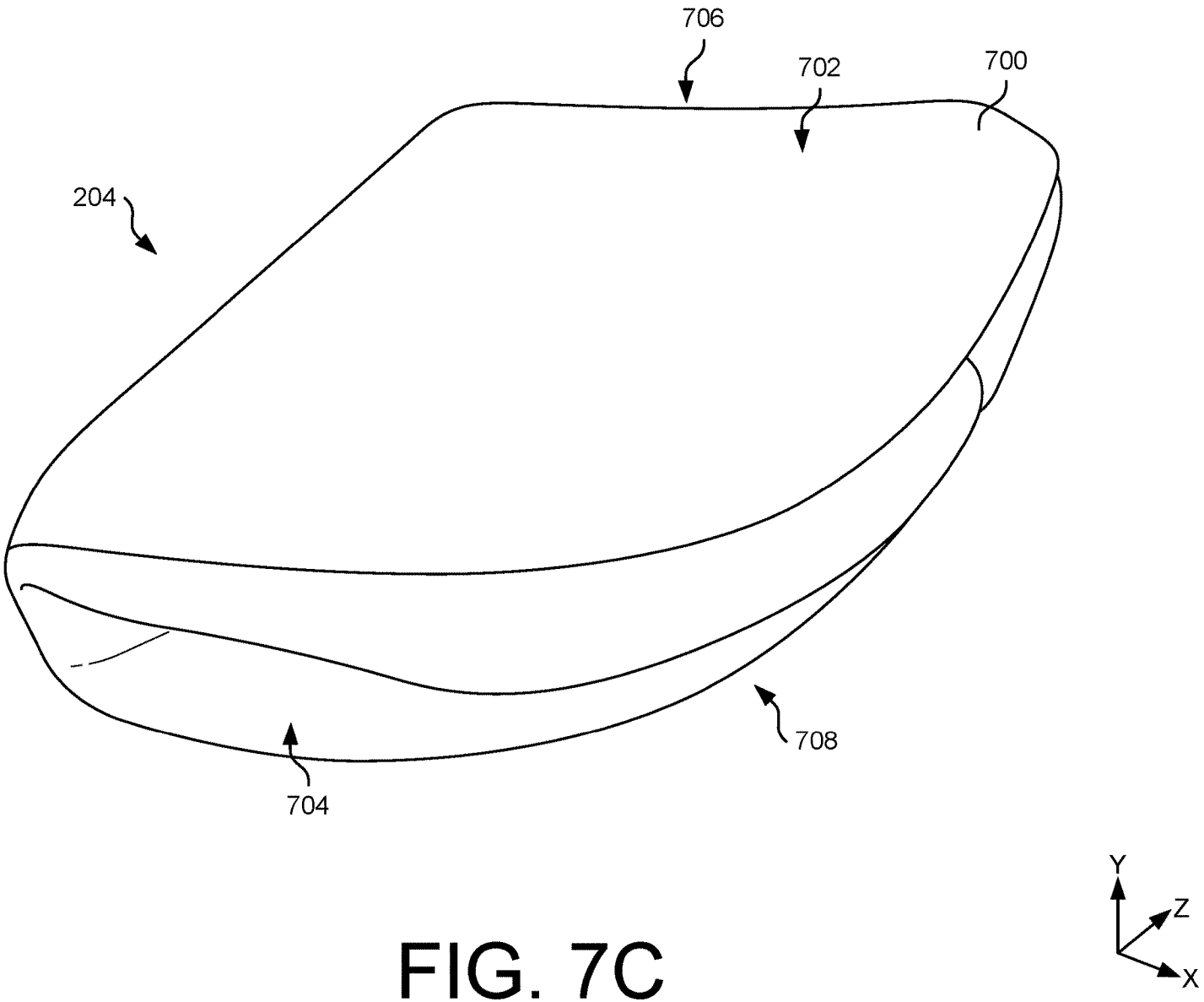

FIGS. 7A-7C illustrate components of the platform 204, according to examples of the present disclosure. The platform 204 may include a second cover 700 disposed over one or more panel(s). The second cover 700 and the one or more panel(s) may reside within the compartment 600 of the first cover 206. The second cover 700 may include a top surface 702 disposed beneath the top surface 604 of the first cover 206, and a bottom surface 704 (opposite the top surface 702) disposed beneath the bottom surface 606 of the first cover 206. The second cover 700 may further include an interior edge 706 and an exterior edge 708 that corresponds to the interior edge 608 and the exterior edge 610 of the platform 204, respectively.

The bottom surface 704 may form a slit 710 (e.g., opening, cut, etc.) for accessing a cavity 712 within the second cover 700. As will be explained herein, the panel(s) may be insertable into the cavity 712 via the slit 710. The second cover 700 may include a padded, waterproof, moist-wicking, and/or meshed material to prevent soiling of the panel(s) and/or to provide padding to the infant.

In FIGS. 7A and 7B, the panel(s), or more generally, the platform 204, is shown being unfolded to form a surface on which the infant may be placed or otherwise rest. The first cover 206, as noted above, may be disposed over the second cover 700 and the panel(s) in the unfolded state. Comparatively, in FIG. 7C, the platform 204 is shown being folded. In the folded configuration, the platform 204 has a reduced footprint for permitting the nursing sling 100 to be easily transported, stored, etc. The first cover 206 and the second cover 700 may fold with the panel(s). As will be explained herein, the panel(s) may be hingedly coupled to one another to permit the platform 204 to be folded and unfolded.

FIGS. 8A-8E illustrate the panels 800 of the platform 204, according to examples of the present disclosure. In FIGS. 8A-8E, the first cover 206 and the second cover 700 are shown removed. For example, the panels 800 may be removed from the second cover 700 via the slit 710.

In some instances, the platform 204 includes a first panel 800(1), a second panel 800(2), and a third panel 800(3). The first panel 800(1) may hingedly couple to the second panel 800(2), and the third panel 800(3) may hingedly couple to the second panel 800(2). Collectively, the panels 800 may provide support, rigidity, etc. to the platform 204 to support the infant. Various padding 802 may be disposed on, about, over, etc. the panels 800 to provide comfort to the infant and/or the user. As will be explained herein, the panels 800 may include a curvature that forms the interior edge 608 and/or the interior edge 706, as well as the exterior edge 610 and/or the exterior edge 708.

Figure 8A:
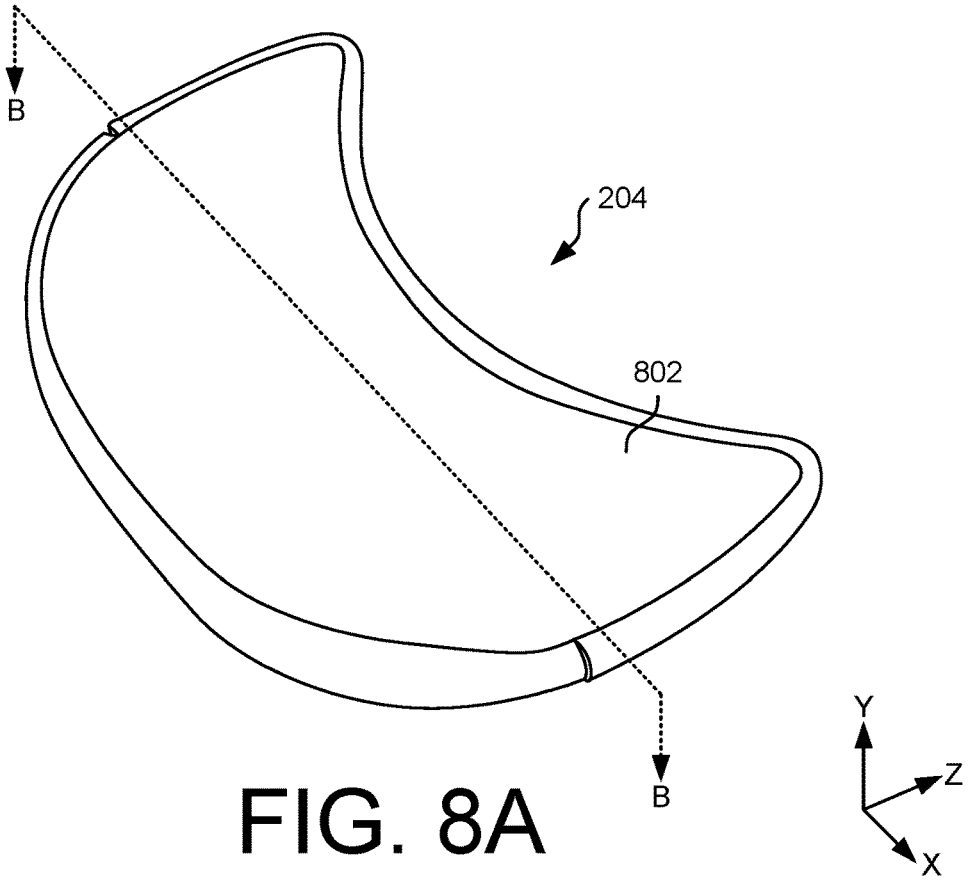
FIGS. 8A-8E illustrate the platform of FIGS. 7A-7C, showing the cover of FIGS. 7A-7C removed, according to examples of the present disclosure.
Figure 8B:
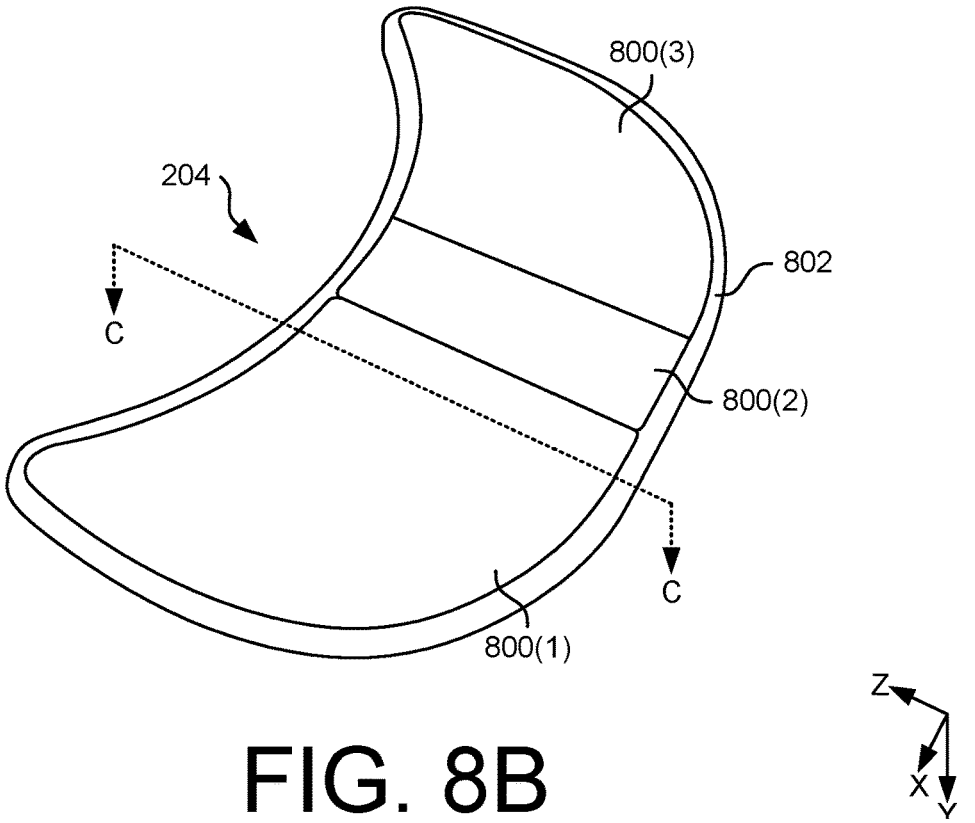
Figure 8C:
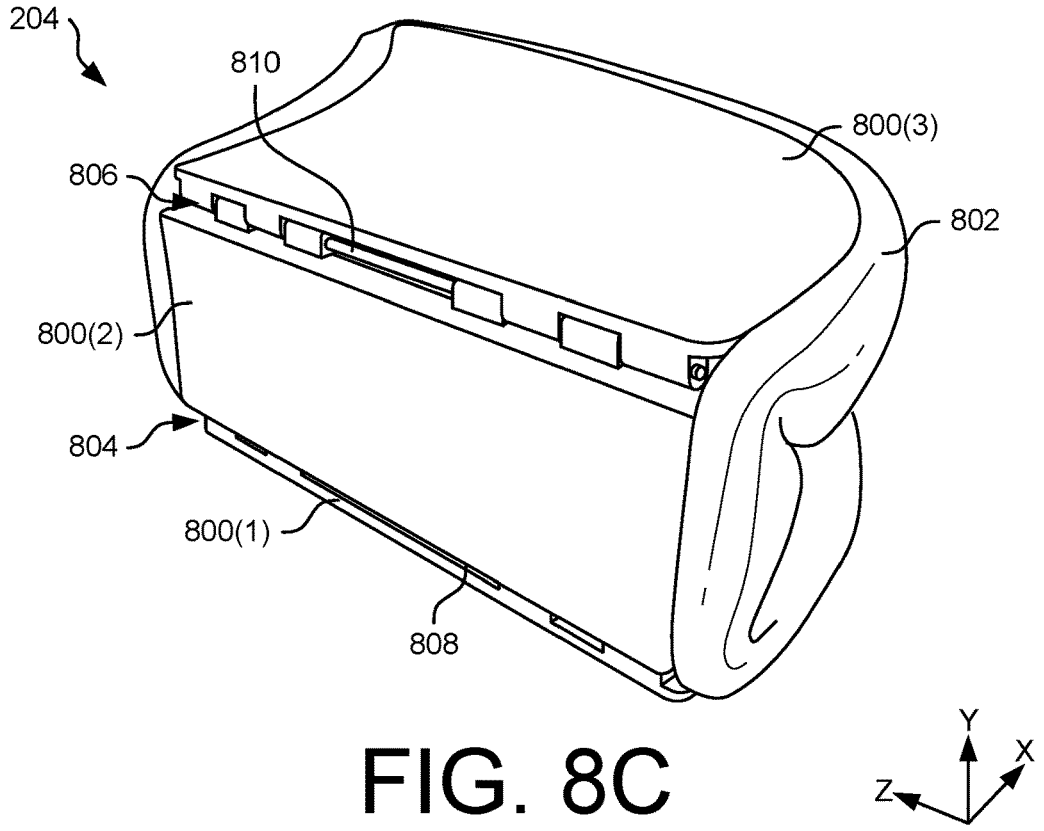
Figure 8D:
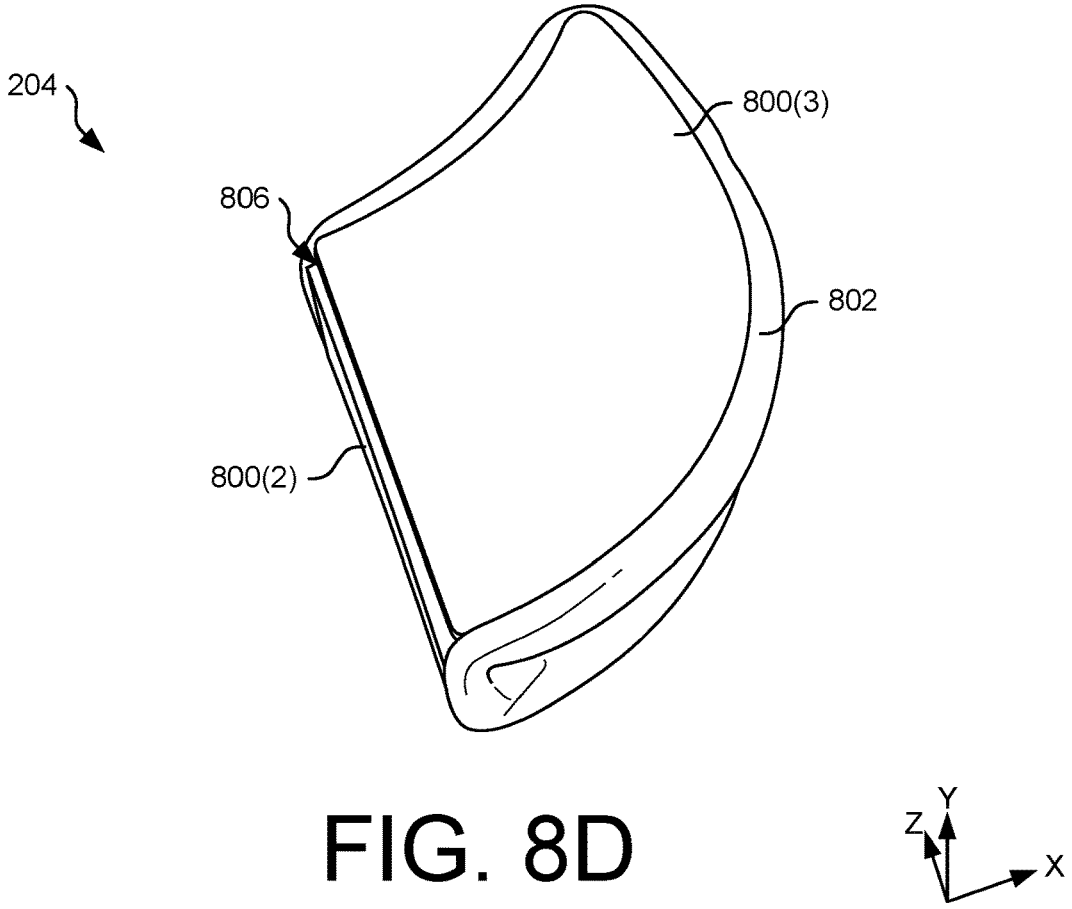

In FIGS. 8A and 8B the platform 204 is shown in the unfolded state. Comparatively, in FIGS. 8C-8E, the platform 204 is shown in the folded state. Here, the first panel 800(1) and the third panel 800(3) may be folded over one another via a hinged coupling with the second panel 800(2), respectively. For example, the first panel 800(1) may couple to the second panel 800(2) via a first hinge 804, while the third panel 800(3) may couple to the second panel 800(2) via a second hinge 806. The panels 800 may include knuckles through which a rod is disposed for hingedly coupling the panels 800 together. For example, a first rod 808 may be disposed through first knuckles of the first panel 800(1) and second knuckles of the second panel 800(2) for hingedly coupling the first panel 800(1) and the second panel 800(2) together. A second rod 810 may be disposed through third knuckles of the second panel 800(2) and fourth knuckles of the third panel 800(3) for hingedly coupling the third panel 800(3) and the second panel 800(2) together.

Although the platform 204 is described as including three of the panels 800, the platform 204 may include or be made up of more than or less than three of the panels 800. For example, the platform 204 may include two panels that hingedly couple together, or may include four panels that hingedly couple together. In some instances, the panels 800 may be made from plastic, metal, composites, and/or any combination thereof.

Figure 8E:
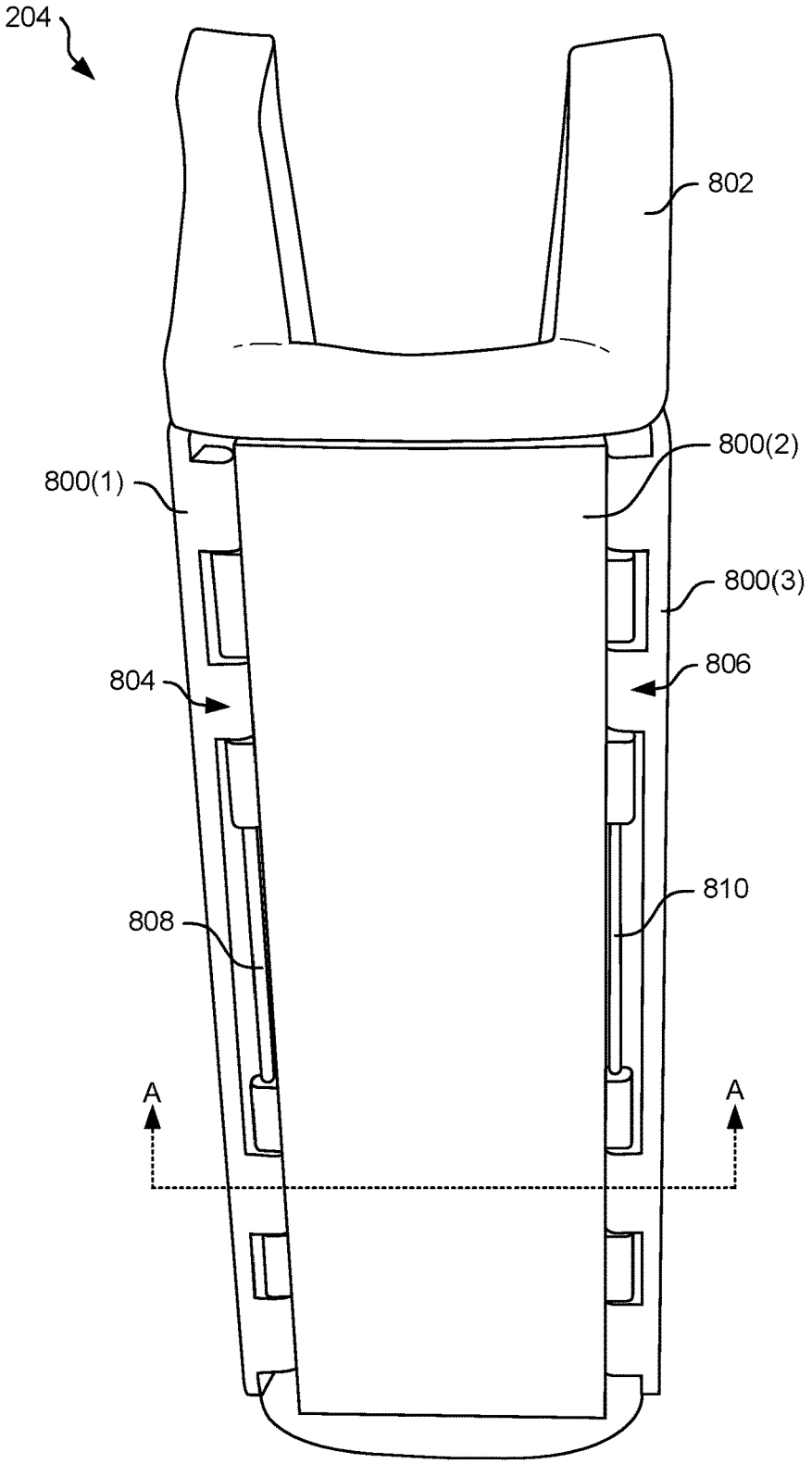
Figure 8E:
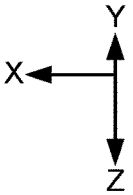
Figure 9A:
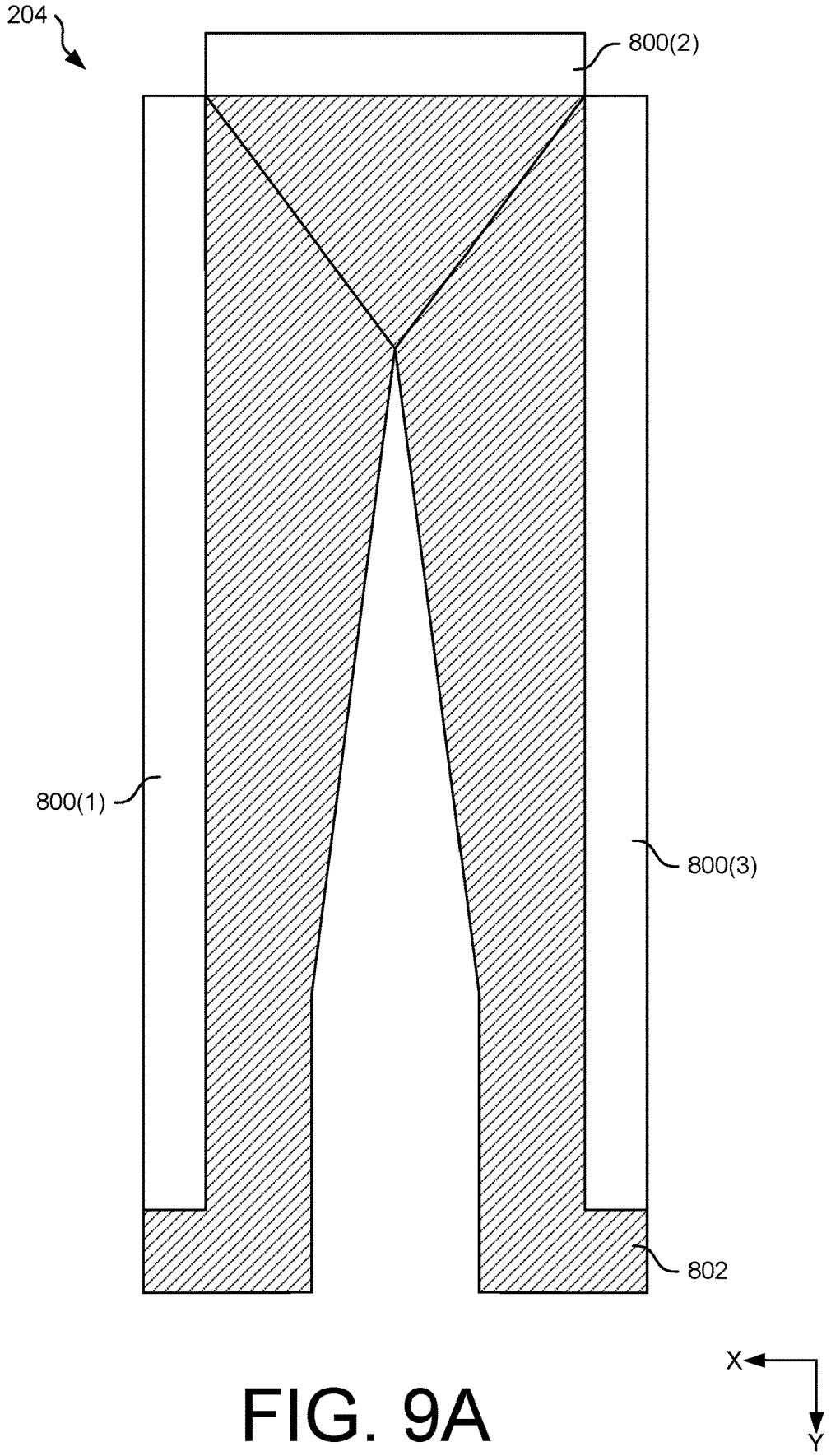
FIGS. 9A-9C illustrate the platform of FIGS. 7A-7C, showing padding of the platform, according to examples of the present disclosure.
Figure 9B:
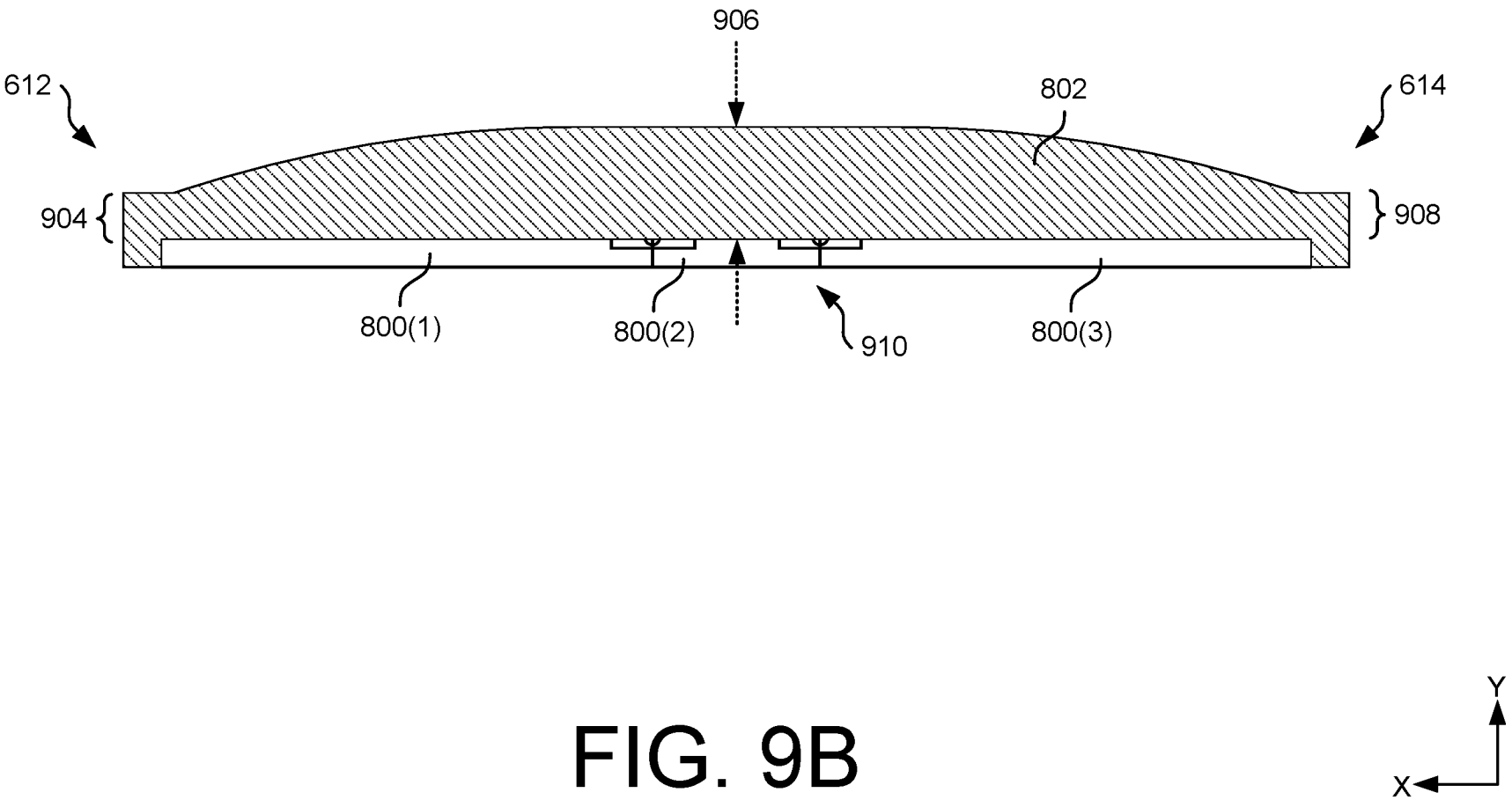
Figure 9C:
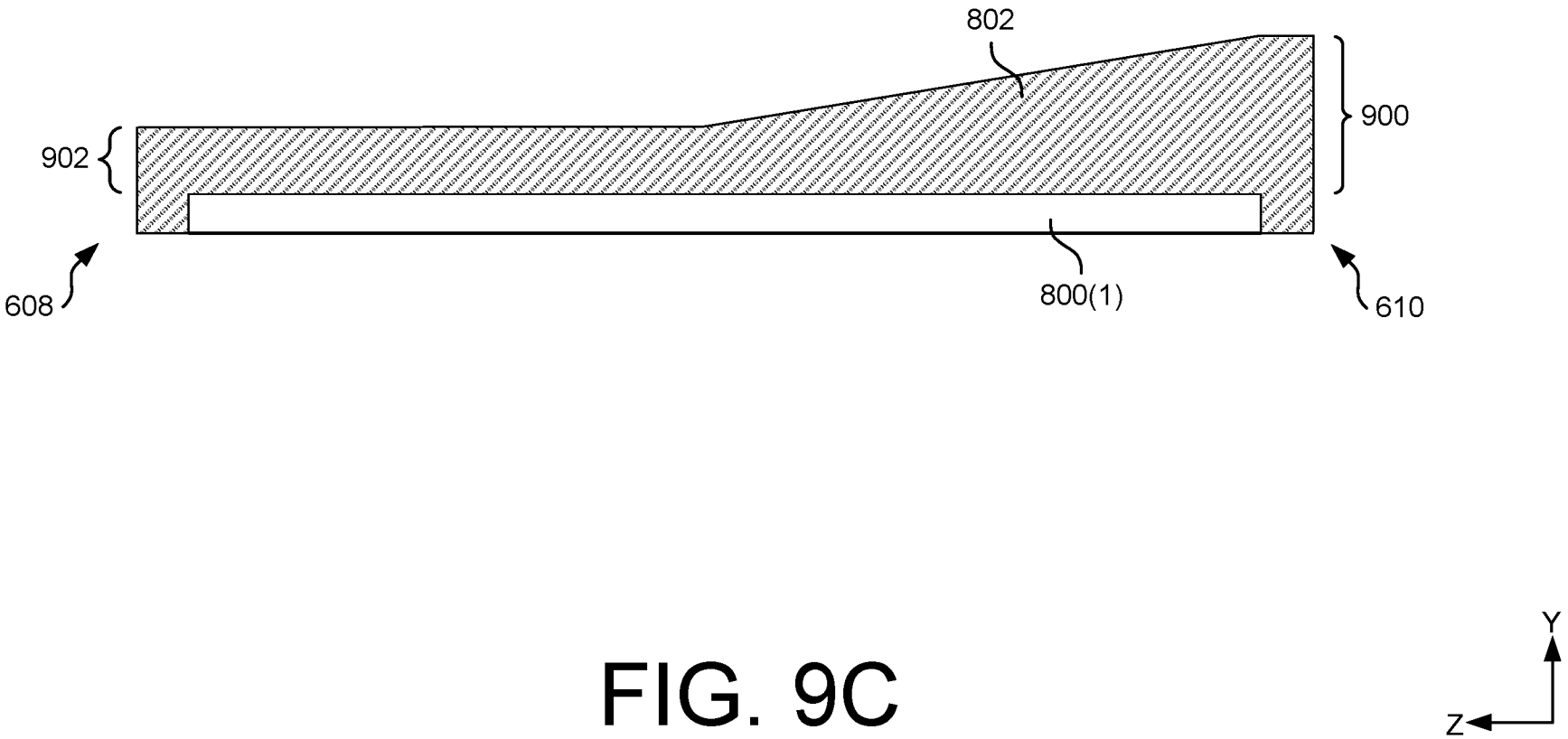

FIGS. 9A-9C illustrate various cross-sectional views of the panels 800 and the padding 802, according to examples of the present disclosure. FIG. 9A illustrates a cross-sectional view of the panels 800 in the folded configuration, taken along line A-A of FIG. 8E, FIG. 9B illustrates a cross-sectional view of the panels 800 in the unfolded configuration, taken along line B-B of FIG. 8A, and FIG. 9C illustrates a cross-sectional view of the panels 800 in the unfolded configuration, taken along line C-C of FIG. 8B.

In some instances, the padding 802 may be disposed around a perimeter formed by the panels 800 and/or on a top surface of the panels 800, respectively (e.g., a surface on which the infant rests). The padding 802 is configured to be deformed to enable the platform 204 to be folded and unfolded. For example, as shown in FIG. 9A, a portion of the padding 802 disposed on the second panel 800(2) may be compressed to enable the platform 204 to be folded. When unfolded, the padding 802 disposed on the second panel 800(2) may expand.

The padding 802 may have different thicknesses across a width (e.g., in the X-direction) and/or depth (e.g., in the Z-direction) of the platform 204. For example, along/at the exterior edge 610 (or the exterior edge 708), the padding 802 may have a first thickness 900 (e.g., in the Y-direction) that is greater than a second thickness 902 along/at the interior edge 608 (or the interior edge 706). The increased thickness along/at the exterior edge 610 may position the infant on the platform 204, and/or provide an incline (e.g., hump, brim, etc.) to urge the infant towards the user to assist in orienting the infant for nursing. In some instances, the increased thickness may maintain the infant on their side when nursing. Between the first thickness 900 and the second thickness 902, the padding 802 may taper (e.g., linearly, parabolically, etc.).

Moreover, the padding 802 may have a third thickness 904 at the first side 612, a fourth thickness 906 within a middle 910 of the platform 204 (e.g., between the first side 612 and the second side 614), and a fifth thickness 908 at the second side 614. The third thickness 904 may be the same as the fifth thickness 908. Additionally, in some instances, the third thickness 904 and/or the fifth thickness 908 may be the same as the second thickness 902. In some instances, the thickness of the padding 802 from the first side 612 to the middle 910 may taper or curve, and/or the thickness of the padding 802 from the second side 614 to the middle 910 may taper or curve.

In some instances, the padding 802 may be adhered (e.g., glued) to the panels 800. In some instances, the padding 802 may include a single piece of padding, or multiple pieces (e.g., sections, portions, etc.) of padding. Moreover, in some instances, the padding 802 may include a constant or single durometer, or multiple durometers such as different types, materials, etc. For example, a first portion of the padding 802 may include a first material, first durometer, etc., while a second portion of the padding 802 may include a second material, a second durometer, etc. that is different than the first material, the first durometer, etc., respectively. The different materials may provide different feels to the user and/or infant, different support to the user and/or infant, and so forth.

FIG. 10 illustrates a perspective view showing the panels 800 coupled together, according to examples of the present disclosure. As introduced above, the panels 800 may include the first panel 800(1), the second panel 800(2), and the third panel 800(3). The second panel 800(2) may hingedly couple to the first panel 800(1) and the third panel 800(3), via the first hinge 804 and the second hinge 806, for enabling the platform 204 to transition between the unfolded state (as shown in FIG. 10) and the folded state. Moreover, as will be discussed herein, the panels 800 may form the interior edge 608, the exterior edge 610, the first side 612, and the second side 614 of the platform 204. The panels 800 may each include a top surface to which the padding 802 is disposed.

Figure 11C:
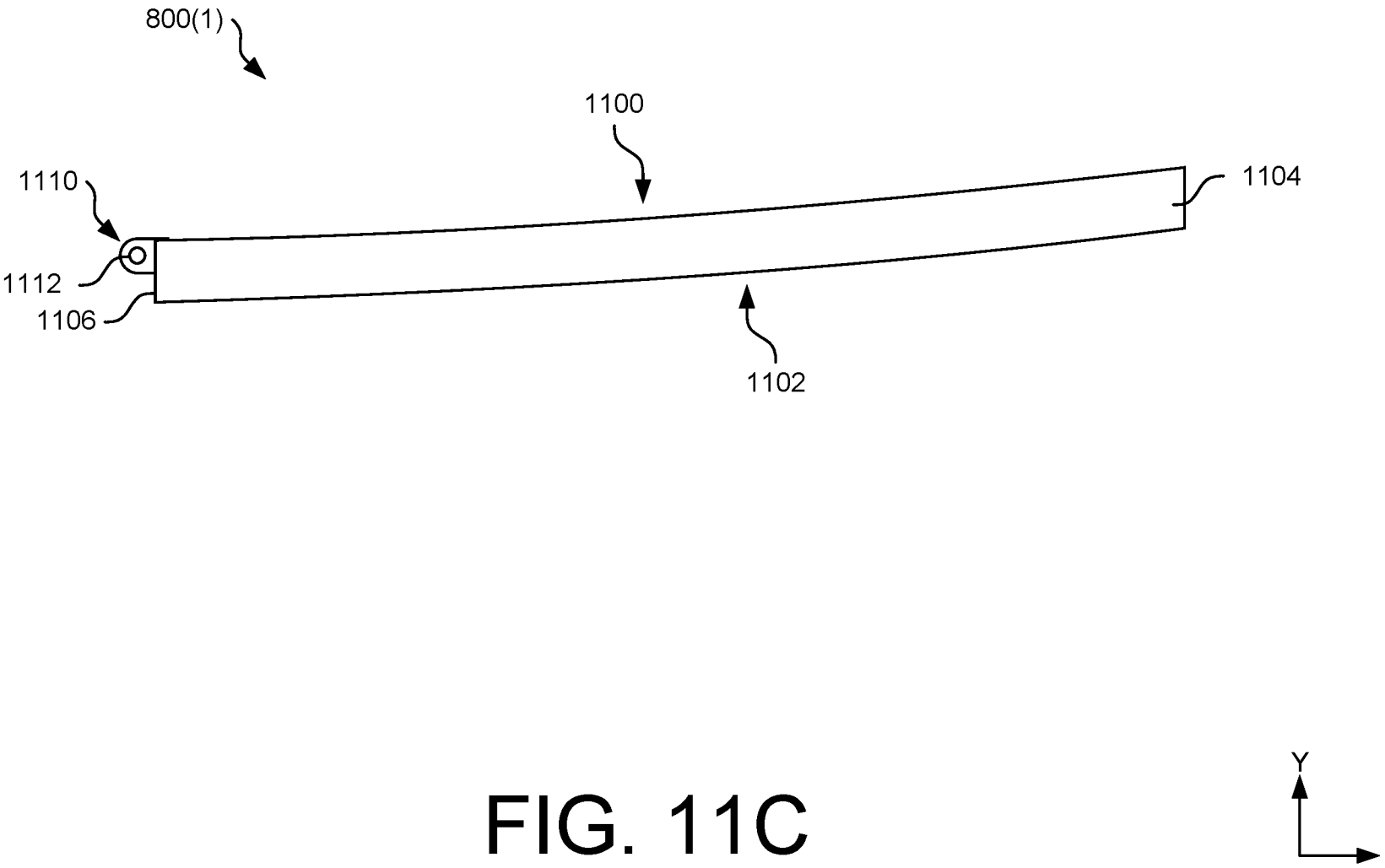

FIGS. 11A-11C illustrate the first panel 800(1), according to examples of the present disclosure. The first panel 800(1) may include a top surface 1100 onto which the padding 802 is disposed, and an opposite bottom surface 1102. The top surface 1100 may be oriented towards the top surface 604 of the platform 204, and the bottom surface 1102 may be oriented towards the bottom surface 606 of the platform 204. In some instances, the top surface 1100 and/or the bottom surface 1102 may be smooth, or may include a roughened or textured surface finish. A thickness of the first panel 800(1) may extend between the top surface 1100 and the bottom surface 1102.

The platform 204 may also include a first side 1104, a second side 1106, and a third side 1108. In some instances, the first panel 800(1) may include a fin-like shape. The first side 1104 may include a curvature that at least partially defines the exterior edge 610 of the platform 204. The second side 1106 may extend transverse from the first side 1104. In some instances, the first side 1104 may be planar (e.g., straight). The third side 1108 may extend from the second side 1106, towards the first side 1104. As shown, the third side 1108 may curve towards the first side 1104, so as to follow the contour of the interior edge 608. The intersection between the first side 1104 and the third side 1108 may form a rounded corner.

The second side 1106 may include first knuckles 1110. The first knuckles 1110 may receive the first rod 808 for hingedly coupling the first panel 800(1) and the second panel 800(2). For example, the first knuckles 1110 may include first channels 1112 that receive the first rod 808. As shown, the second side 1106 may include four of the first knuckles 1110, however, the second side 1106 may include more than or less than four of the first knuckles 1110. As shown, two of the first knuckles 1110 may be disposed along the second side 1106, proximate to the first side 1104, and/or two of the first knuckles 1110 may be disposed along the second side 1106, proximate to the third side 1108. The first knuckles 1110 will receive knuckles of the second panel 800(2).

In some instances, the first knuckles 1110 may extend from the second side 1106 (e.g., in the X-direction) more proximate to the top surface 1100 as compared to the bottom surface 1102. In doing so, the platform 204 may lay flat and/or prevent over rotation of the first hinge 804. For example, a portion of the second side 1106 may be disposed below the first knuckles 1110, but above the bottom surface 1102. That is, the portion of the second side 1106 below the first knuckles 1110 may abut or otherwise engage with a portion of the second panel 800(2) for providing support to the platform 204 and to prevent the first hinge 804 over rotating.

As further shown, the first panel 800(1) may curve or bow (e.g., in the Y-direction) between the first side 1104 and the second side 1106 (e.g., in the Y-direction). The curvature of the first panel 800(1) may be such that when the platform 204 receives the infant (e.g., is loaded), the first panel 800(1) may lay flat.

Figure 12B:
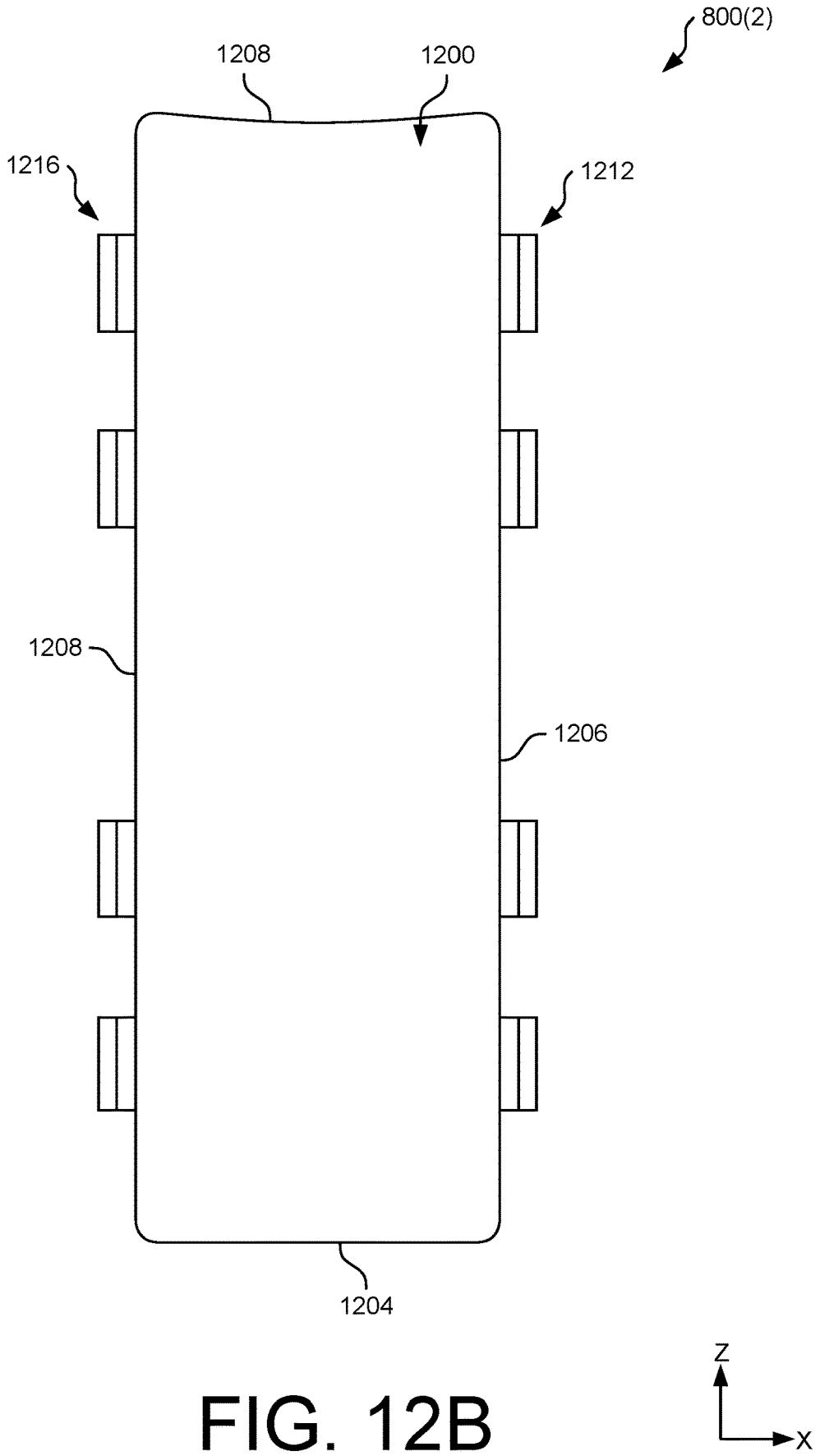

FIGS. 12A-12C illustrate the second panel 800(2), according to examples of the present disclosure. The second panel 800(2) may include a top surface 1200 onto which the padding 802 is disposed, and an opposite bottom surface 1202. The top surface 1200 may be oriented towards the top surface 604 of the platform 204, and the bottom surface 1202 may be oriented towards the bottom surface 606 of the platform 204. In some instances, the top surface 1200 and/or the bottom surface 1202 may be smooth, or may include a roughened or textured surface finish. A thickness of the second panel 800(2) may extend between the top surface 1200 and the bottom surface 1202.

The platform 204 may also include a first side 1204, a second side 1206, a third side 1208, and a fourth side 1210. In some instances, the second panel 800(2) may include a rectangular-shape. In some instances, the first side 1204, the second side 1206, and/or the fourth side 1210 may be planar. The third side 1208 may include a curvature that corresponds to the curvature of the interior edge 608. In some instances, the second side 1206 extends transverse to the first side 1204, the third side 1208 extends transverse to the second side 1206, the fourth side 1210 extends transverse from the third side 1208, and/or the first side 1204 may extend transverse from the third side 1208.

The second side 1206 may include second knuckles 1212 that are complimentary to the first knuckles 1110. The second knuckles 1212 may receive the first rod 808 for hingedly coupling the first panel 800(1) and the second panel 800(2). For example, the second knuckles 1212 may include second channels 1214 that receive the first rod 808. The fourth side 1210 may include third knuckles 1216 that are complimentary to the knuckles of the second panel 800(2). The third knuckles 1216 may receive the second rod 810 for hingedly coupling the second panel 800(2) and the third panel 800(3). For example, the third knuckles 1216 may include third channels 1218 that receive the second rod 810. The first knuckles 1110 and the second knuckles 1212, as well as the first rod 808 disposed therethrough, may form the first hinge 804.

As shown, the second side 1206 and the fourth side 1210 may include four of the second knuckles 1212 and four of the third knuckles 1216, respectively, however, the second side 1206 and/or the fourth side 1210 may include more than or less than four of the second knuckles 1212 and/or more than or less than four of the third knuckles 1216. As shown, two of the second knuckles 1212 may be disposed along the second side 1206, proximate to the first side 1204, and/or two of the second knuckles 1212 may be disposed along the second side 1206, proximate to the third side 1208. Additionally, two of the third knuckles 1216 may be disposed along the fourth side 1210, proximate to the third side 1208, and/or two of the third knuckles 1216 may be disposed along the fourth side 1210, proximate to the first side 1204. In some instances, the second knuckles 1212 may be aligned (e.g., about the X-plane) with the third knuckles 1216, respectively.

In some instances, the second knuckles 1212 may extend from the second side 1206 (e.g., in the X-direction) more proximate to the top surface 1200 as compared to the bottom surface 1202. In doing so, the platform 204 may lay flat and/or prevent over rotation of the first hinge 804. For example, a portion of the second side 1206 may be disposed below the second knuckles 1212, but above the bottom surface 1202. That is, the portion of the second side 1206 below the second knuckles 1212 may abut or otherwise engage with a portion of the first panel 800(1) for providing support to the platform 204 and to prevent the first hinge 804 over rotating. Similarly, the third knuckles 1216 may extend from the fourth side 1210 (e.g., in the X-direction) more proximate to the top surface 1200 as compared to the bottom surface 1202. In doing so, the platform 204 may lay flat and/or prevent over rotation of the second hinge 806. For example, a portion of the fourth side 1210 may be disposed below the third knuckles 1216, but above the bottom surface 1202. That is, the portion of the fourth side 1210 below the third knuckles 1216 may abut or otherwise engage with a portion of the third panel 800(3) for providing support to the platform 204 and to prevent the second hinge 806 over rotating.

As further shown, the second panel 800(2) may curve or bow (e.g., in the Y-direction) between the second side 1206 and the fourth side 1210 (e.g., in the Y-direction). The curvature of the second panel 800(2) may be such that when the platform 204 receives the infant (e.g., is loaded), the second panel 800(2) may lay flat.

Figure 13C:
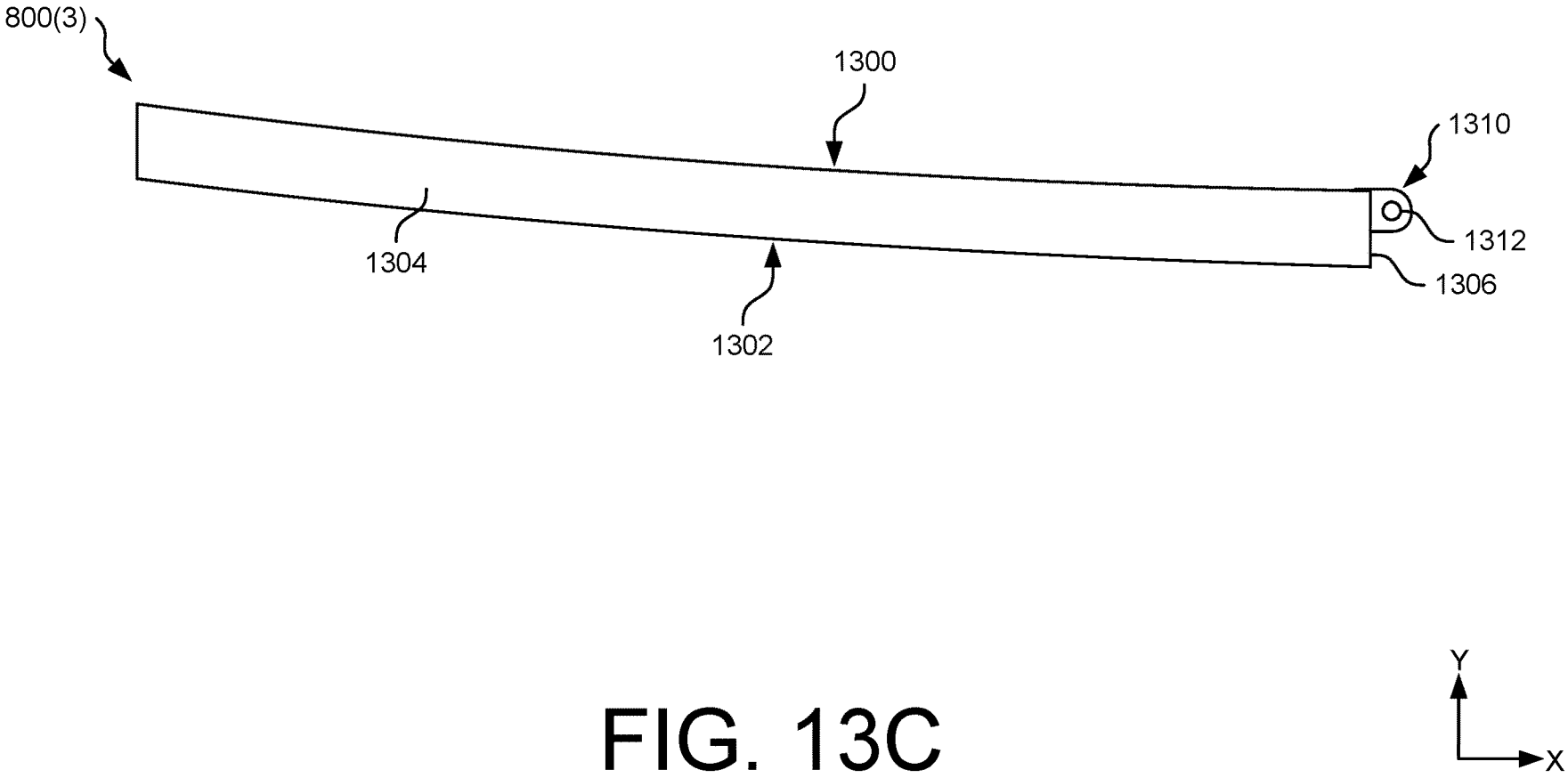

FIGS. 13A-13C illustrate the third panel 800(3), according to examples of the present disclosure. The third panel 800(3) may include a top surface 1300 onto which the padding 802 is disposed, and an opposite bottom surface 1302. The top surface 1300 may be oriented towards the top surface 604 of the platform 204, and the bottom surface 1302 may be oriented towards the bottom surface 606 of the platform 204. In some instances, the top surface 1300 and/or the bottom surface 1302 may be smooth, or may include a roughened or textured surface finish. A thickness of the third panel 800(3) may extend between the top surface 1300 and the bottom surface 1302.

The platform 204 may also include a first side 1304, a second side 1306, and a third side 1308. In some instances, the third panel 800(3) may include a fin-like shape. The first side 1304 may include a curvature that at least partially defines the exterior edge 610 of the platform 204. The second side 1306 may extend transverse from the first side 1304. In some instances, the second side 1306 may be planar (e.g., straight). The third side 1308 may extend from the second side 1306, towards the first side 1304. As shown, the third side 1308 may curve towards the first side 1304, so as to follow the contour of the interior edge 608. The intersection between the first side 1304 and the third side 1308 may form a rounded corner.

The second side 1306 may include fourth knuckles 1310. The fourth knuckles 1310 may receive the second rod 810 for hingedly coupling the second panel 800(2) and the third panel 800(3). For example, the fourth knuckles 1310 may include fourth channels 1312 that receive the second rod 810. As shown, the second side 1306 may include four of the fourth knuckles 1310, however, the second side 1306 may include more than or less than four of the fourth knuckles 1310. As shown, two of the fourth knuckles 1310 may be disposed along the second side 1306, proximate to the first side 1304, and/or two of the first knuckles 1110 may be disposed along the second side 1306, proximate to the third side 1308.

In some instances, the fourth knuckles 1310 may extend from the second side 1306 (e.g., in the X-direction) more proximate to the top surface 1300 as compared to the bottom surface 1302. In doing so, the platform 204 may lay flat and/or prevent over rotation of the second hinge 806. For example, a portion of the second side 1306 may be disposed below the fourth knuckles 1310, but above the bottom surface 1302. That is, the portion of the second side 1306 below the fourth knuckles 1310 may abut or otherwise engage with a portion of the second panel 800(2) for providing support to the platform 204 and to prevent the second hinge 806 over rotating.

As further shown, the third panel 800(3) may curve or bow (e.g., in the Y-direction) between the first side 1304 and the second side 1306 (e.g., in the Y-direction). The curvature of the third panel 800(3) may be such that when the platform 204 receives the infant (e.g., is loaded), the third panel 800(3) may lay flat.

Figure 14A:
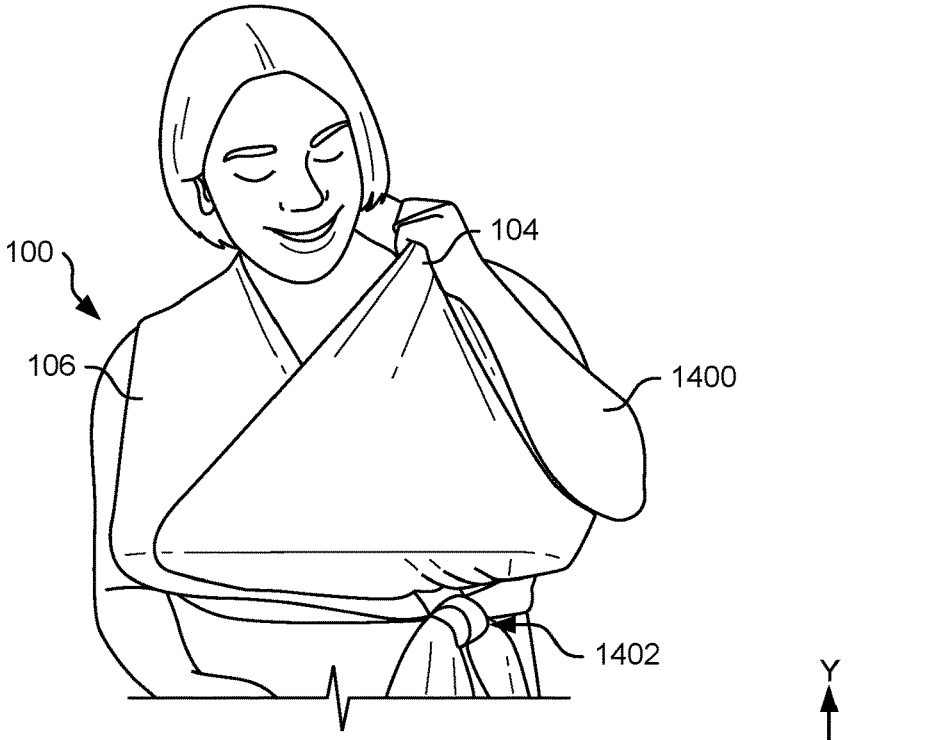
Figure 14B:
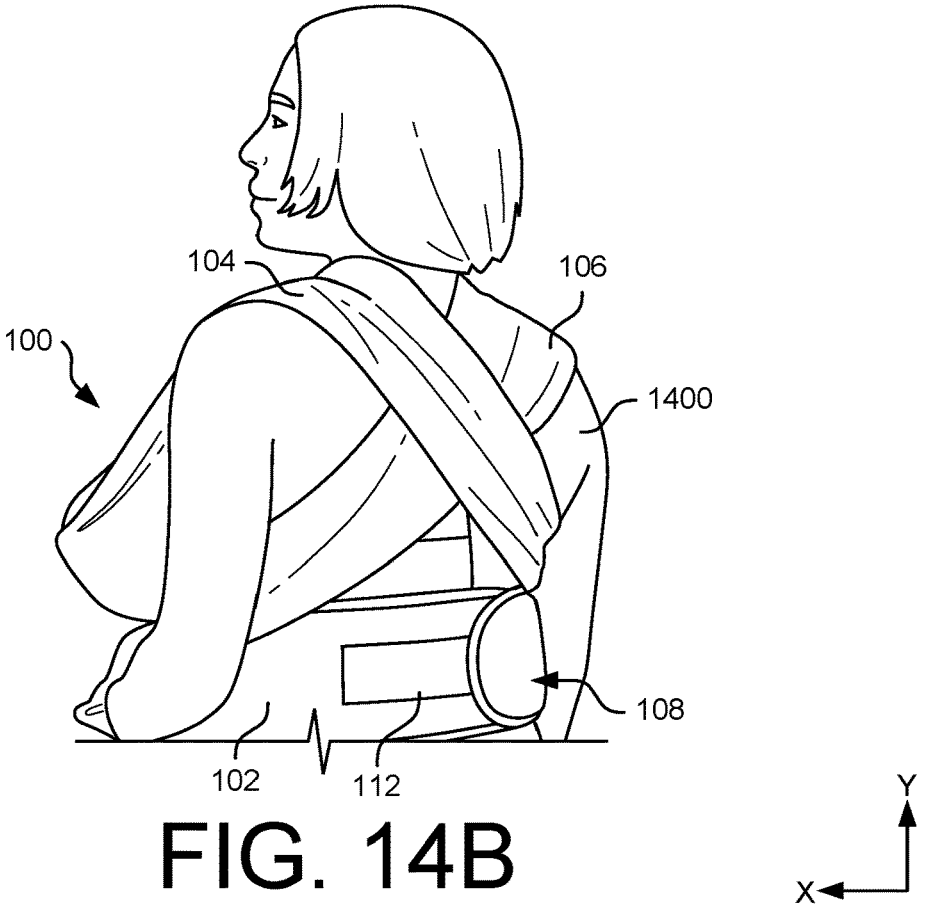

FIGS. 14A-14C illustrate an example use of the nursing sling 100, according to examples of the present disclosure. The belt 102 may be worn around a user 1400, such as the waist, hip, abdomen, chest, etc. of the user 1400. In some instances, the first end 108 of the belt 102 and the second end 110 of the belt 102 may be secured together, via the first attachment mechanism 112 and the second attachment mechanism 200, along a back of the user 1400. When worn by the user 1400, the first side 114 of the belt 102 may be oriented outwards (e.g., away from) the user 1400, while the second side 202 of the belt 102 may be oriented towards the user 1400. Additionally, when worn, the user 1400 may be seated or standing.

The first strap 104 and the second strap 106 extend from the belt 102, along a front of the user 1400, over the platform 204, and over the shoulders of the user 1400. In some instances, the first strap 104 may wrap over the left shoulder of the user 1400, while the second strap 106 may wrap over the right shoulder of the user 1400. The first strap 104 and the second strap 106 may crisscross along the back of the user 1400. For example, the first strap 104 may wrap from the left shoulder, to under the right arm of the user 1400. The second strap 106 may wrap from the right shoulder, to under the left arm of the user 1400. Therein, the first strap 104 and the second strap 106 may wrap around to in front of the user 1400 for being tied in a knot 1402. More particularly, the second end 302 of the first strap 104 and the second end 402 of the second strap 106 may be tied together to form the knot 1402. In some instances, the knot 1402 may be disposed adjacent to the first side 114 of the belt 102. Moreover, as discussed herein, the second end 302 of the first strap 104 and the second end 402 of the second strap 106 may be pulled by varying lengths to adjust the position, orientation, etc. of the platform 204. Doing so may assure that the platform 204 if securely supported and/or that the platform 204 is comfortably worn by the user 1400. Moreover, being as the first strap 104 and the second strap 106 support the platform 204 (and therefore, an infant), the nursing sling 100 may be operated hands-free while the infant is nursing and the mother is sitting down for safety. However, in instances in which the user 1400 is standing, the user 1400 may provide additional support to the platform 204 via one or more hands of the user 1400.

The nursing sling 100 forms a cavity 1404 (e.g., pocket, compartment, etc.) in which an infant 1406 is placed for nursing. For example, because the platform 204 extends outward from the user 1400, and the first strap 104 and the second strap 106 wrap around the exterior edge 610 of the platform 204 to over the shoulders of the user 1400, the cavity 1404 may provide a place for the infant 1406 to be nursed. In other words, the first strap 104 and the second strap 106 may provide a shroud around the infant 1406. Within the cavity 1404, the infant 1406 may be placed on their side for nursing, and the infant is held within the cavity 1404 via the first strap 104 and the second strap 106.

The cavity 1404 may not be sealed, but may be open on ends, a top, etc. to allow breathability and to permit the user 1400 to view/observe the infant 1406. Furthermore, the first strap 104 and the second strap 106 may be at least partially moved (e.g., in the X-direction), such as sliding along the exterior edge 610, to permit the infant 1406 to be placed into and removed from the cavity 1404. Within the cavity 1404, there is enough open space above the infant 1406 for the user 1400 to see inside. However, at the same time, the first strap 104 and the second strap 106 provide privacy. The fabric of the first strap 104 and the second strap 106 are easily stretchable and breathable, allowing the user to maneuver the infant 1406 during nursing.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative of some embodiments that fall within the scope of the claims of the application.

What is claimed is:

1. A device comprising:

a belt;

a first strap including:

a first end coupled to the belt, a second end, a first side, and a second side having a first band disposed at least partially between the first end and the second end;

a second strap including:

a third end coupled to the belt, a fourth end, a third side, and a fourth side having a second band at least partially disposed between the third end and the fourth end;

a cover coupled to the belt; and a platform disposed within the cover, the platform being configured to transition between a folded state and an unfolded state via one or more hinges, the platform including padding disposed on at least one side of the platform.

2. The device of claim 1, wherein in the unfolded state:

the platform includes an interior edge and an exterior edge;

the padding includes a first thickness proximate to the interior edge; and the padding includes a second thickness proximate to the exterior edge, the second thickness being greater than the first thickness.

3. The device of claim 1, wherein:

the platform includes:

a first panel, a second panel, and a third panel; and the one or more hinges include:

a first hinge that hingedly couples the first panel and the second panel, and a second hinge that hingedly couples the second panel and the third panel.

4. The device of claim 1, wherein the belt includes:

a first side;

a second side opposite the first side of the belt;

a first end;

a second end opposite the first end of the belt;

a first attachment mechanism disposed on the first side of the belt; and a second attachment mechanism configured to engage with the first attachment mechanism, the second attachment mechanism being disposed on the second side of the belt, more proximate to the first end of the belt than the second end of the belt.

5. The device of claim 1, wherein:

the cover defines a compartment that is accessible via a zipper; and the platform is at least partially disposed within the compartment.

6. The device of claim 1, wherein the belt includes one or more pockets.

7. The device of claim 1, wherein:

the belt includes a top and a bottom; and at least a portion of the cover couples to the belt at a location that is closer to the top than a location at which the first strap couples to the belt and a location at which the second strap couples to the belt.

* * * * *